US007276843B2

(12) United States Patent
Sasaguri

(10) Patent No.: US 7,276,843 B2
(45) Date of Patent: Oct. 2, 2007

(54) ELECTRON-EMITTING DEVICE WITH ELECTRON BLOCKING LAYER, ELECTRON SOURCE, AND IMAGE-FORMING APPARATUS

(75) Inventor: Daisuke Sasaguri, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 20 days.

(21) Appl. No.: 10/178,273

(22) Filed: Jun. 25, 2002

(65) Prior Publication Data

US 2003/0001477 A1 Jan. 2, 2003

(30) Foreign Application Priority Data

Jun. 29, 2001 (JP) ..... 2001-200126
Jun. 14, 2002 (JP) ..... 2002-174599

(51) Int. Cl.
*H01J 9/02* (2006.01)

(52) U.S. Cl. ..... 313/310; 313/309; 313/346 R; 313/495

(58) Field of Classification Search ..... 313/309–311, 313/495, 496, 346 R, 336, 351
See application file for complete search history.

(56) References Cited

U.S. PATENT DOCUMENTS 5,562,516 A 10/1996 Spindt et al. ..... 445/24
5,773,921 A 6/1998 Keesman et al. ..... 313/309
6,062,931 A 5/2000 Chuang et al. ..... 445/24
6,103,133 A 8/2000 Sakuma et al. ..... 216/11
6,190,223 B1 * 2/2001 Tjaden et al. ..... 445/24
6,288,494 B1 * 9/2001 Tsukamoto et al. ..... 315/169.1
6,624,589 B2 * 9/2003 Kitamura et al. ..... 315/169.3

FOREIGN PATENT DOCUMENTS

EP 0 905 737 3/1999

(Continued)

OTHER PUBLICATIONS

J. Robertson; "Amorphous Carbon Cathodes for Field Emission Display," Thin Solid Films 296 (1997) 61-65.

(Continued)

*Primary Examiner*—Nimeshkumar D. Patel
*Assistant Examiner*—Kevin Quarterman
(74) *Attorney, Agent, or Firm*—Fitzpatrick, Cella, Harper & Scinto

(57) ABSTRACT

An object of the present invention is to enhance a converging property of an electron beam in an electron-emitting device in which a cathode electrode, an insulating layer, and a gate electrode are laminated and a through hole is formed by partially removing the gate electrode so as to obtain an exposed portion of the cathode electrode. In such an,electron-emitting device in which the cathode electrode, the insulating layer, and the gate electrode are laminated and the through hole is formed by partially removing the gate electrode so as to obtain the exposed portion of the cathode electrode, only a central region of the electron-emitting layer on the cathode electrode is connected to the cathode electrode. With this structure, it becomes possible to generate an electron beam only from the central region of the electron-emitting layer connected to the cathode electrode and to realize an electron-emitting device having a small beam diameter and a high-definition image-forming apparatus.

31 Claims, 23 Drawing Sheets

FOREIGN PATENT DOCUMENTS

| | | | |
|---|---|---|---|
| EP | 0 923 104 | | 6/1999 |
| EP | 1 032 020 | A2 | 8/2000 |
| EP | 1 102 299 | | 5/2001 |
| EP | 1 117 118 | | 7/2001 |
| GB | 1 340 353 | | 12/1973 |
| JP | 8-96704 | | 4/1996 |
| JP | 8-115654 | | 5/1996 |
| JP | 08-329824 | | 12/1996 |
| JP | 2000-215792 | | 8/2000 |
| JP | 2000-323013 | | 11/2000 |
| JP | 2001-110299 | | 4/2001 |
| KR | 2001-0044952 | | 6/2001 |

OTHER PUBLICATIONS

T. Kusunoki et al., "Fluctuation-Free Electron Emission from Non-Formed Metal-Insulator-Metal (MIM) Cathodes Fabricated by Low Current Anodic Oxidation", Japanese Journal of Applied Physics, vol. 32 1993, pp. L1695-L1697.

C.A. Mead, "Operation of Tunnel-Emission Devices", Journal of Applied Physics, vol. 32, No. 4, Apr. 1961, pp. 646-652.

G. Dittmer, "Electrical Conduction And Electron Emission Of Discontinuous Thin Films", Thin Solid Films, 9, 1972, pp. 317-328.

M.L. Elinson et al., "The Emission Of Hot Electrons And The Field Emission Of Electrons From Tin Oxide", Radio Engineering and Electronic Physics, No. 7, Jul. 1965, pp. 1290-1296.

C.A. Spindt et al., "Physical properties of thin-film field emission cathodes with molybdenum cones", Journal of Applied Physics, vol. 47, No. 12, Dec. 1976, pp. 5248-5263.

M. Hartwell et al., "Strong Electron Emission From Patterned Tin-Indium Oxide Thin Films", Technical Digest 1975 International Electron Devices Meeting, Dec. 1, 2 and 3, 1975, pp. 519-521.

W.P. Dyke et al., "Field Emission", Advances in Electronics and Electron Physics, vol. VIII, 1956, pp. 89-185.

* cited by examiner

ELECTRON-EMITTING DEVICE WITH ELECTRON BLOCKING LAYER, ELECTRON SOURCE, AND IMAGE-FORMING APPARATUS

BACKGROUND OF THE INVENTION

1. Field of the Invention

The present invention relates to an electron-emitting device that performs electron emission through the application of a voltage, an electron source, and an image-forming apparatus.

2. Description of the Related Art

Electron-emitting devices heretofore known are generally grouped into two types: a thermionic cathode type and a cold-cathode type. Cold-cathode electron-emitting devices include field-emission (hereafter referred to as FE-type) devices, metal-insulator-metal (hereafter referred to as MIM-type) devices, and surface conduction electron-emitting devices, For example, an FE-type device, such as the one disclosed by W. P. Dyke and W. W. Dolan in "Field Emission", Advance in Electron Physics, 8, 89 (1956), or the one disclosed by C. A. Spindt in "PHYSICAL Properties of thin-film field emission cathodes with molybdenum cones", J. Appl. Phys., 47, 5248 (1976), is known.

An MIM-type device, such as the one disclosed by C. A. Mead in "Operation of Tunnel-Emission Devices", J. Apply. Phys., 32,646 (1961), is known.

Also, examples of devices which have been recently studied are as follows: Toshiaki, Kusunoki, "Fluctuation-free electron emission from non-formed metal-insulator-metal (MIM) cathodes fabricated by low current Anodic oxidation", Jpn. J. Appl. Phys. vol. 32 (1993) pp. L1695, and Mutsumi Suzuki et al., "An MIM-Cathode Array for Cathode luminescent Displays", IDW'96, (1996) pp. 529.

An example of the surface conduction electron-emitting device is reported by M. I. Elinson in Radio Eng. Electron Phys., 10, (1965). The surface conduction electron-emitting device uses a phenomenon where electrons are emitted when an electric current is allowed to flow in parallel to the surface of a thin film that has a small area and is formed on a substrate. While Elinson proposes the use of an $SnO_2$ thin film for the surface conduction device, the use of an Au thin film (G. Dittmer, Thin Solid Films, 9, 317 (1972)) and the use of an $In_2O_3/SnO_2$ thin film (M. Hartwell and C. G. Fonstad, IEEE Trans. ED Conf., 519 (1983)) are also proposed.

SUMMARY OF THE INVENTION

By the way, in an image display apparatus, electrons emitted from an electron-emitting device collide against a phosphor (anode electrode) arranged so as to oppose the electron-emitting device, thereby having the phosphor emit light. However, in a high-definition image-forming apparatus, the electron-emitting device is asked for convergence of the emitted electron beam trajectory, miniaturization of the size, simplification of the producing method and reduction of the driving voltage.

As to the FE type electron-emitting device, there is widely known a Spindt type electron-emitting device shown in FIG. 20. The tip of its electron-emitting region has a sharp-pointed structure, so that it is difficult to converge an electron beam and it is also difficult to realize a high-definition image-forming apparatus.

There is also proposed a device structure where a focusing electrode for converging an electron beam is provided in the Spindt type electron-emitting device, although there occur various problems. For instance, the device structure and manufacturing method are complicated.

In contrast to this, for instance, JP08-96704 A proposes an electron-emitting device having the structure shown in FIG. 21 where an approximately flat electron-emitting layer is formed within an opening portion of a gate electrode and an insulating layer. With this structure, there is suppressed the widening of an electron beam. However, the electrons emitted from the end regions of the electron-emitting layer greatly spread out along an electric field formed by the gate electrode and a cathode electrode as shown in FIG. 22.

Also, in an example disclosed in JP 08-115654 A, there is proposed a structure where in order to converge an electron beam, a part of a cathode electrode is concaved and an electron-emitting layer is arranged in the concaved region. In the case of this structure, as shown in FIG. 23, if the electron-emitting layer adheres to the side walls of the concaved region or a region other than the concaved region, for instance, there is not obtained an effect of converging an electron beam. Consequently, there is required a technique with which it is possible to perform an alignment operation with a high degree of precision during the manufacturing of the device. This causes a problem concerning the uniformity of devices.

In order to attain the above-mentioned object, the present invention relates to an electron-emitting device in which: a cathode electrode and agate electrode are arranged on a substrate; an electron is transported from the cathode electrode to an electron-emitting layer arranged on the cathode electrode; and the electron is emitted into a vacuum from the electron-emitting layer, the device being characterized in that a portion of the electron-emitting layer is connected to the cathode electrode through an electron blocking layer.

Also, it is preferable that the cathode electrode and the gate electrode are laminated through an insulating layer.

Also, it is preferable that: an opening portion penetrating the insulating layer and the gate electrode layer is provided; the electron-emitting layer is arranged on the cathode electrode layer within the opening portion; and the electron-emitting layer includes a region that directly contacts the cathode electrode and a region that contacts the cathode electrode through the electron blocking layer made of one of an insulator and a semiconductor.

Also, it is preferable that the region, in which the electron-emitting layer contacts the cathode electrode, exists closer to a central portion within a region of the electron-emitting layer than the region in which the electron-emitting layer contacts the electron blocking layer.

It is preferable that if an energy difference between the cathode electrode and a conduction band of the electron blocking layer within the region, in which the electron-emitting layer contacts the electron blocking layer, is referred to as El and an energy difference between the cathode electrode and the conduction band of the electron-emitting layer within the region, in which the electron-emitting layer contacts the cathode electrode, is referred to as E2, the following relation exists between E1 and E2:

E1>E2.

Also, it is preferable that an upper end surface of the cathode electrode contacting the electron-emitting layer exists at a position that is closer to the substrate side than an upper end surface of the cathode electrode contacting the electron blocking layer.

Also, it is preferable that a main ingredient of the electron-emitting layer is carbon.

Also, it is preferable that the electron-emitting layer has a band gap whose numerical value is positive.

Also, it is preferable that the electron-emitting layer is one of a diamond like carbon film and an amorphous carbon film.

Also, it is preferable that: the electron-emitting layer is connected to the cathode electrode and the electron blocking layer through a catalytic conductive layer; a main ingredient of the electron-emitting layer is carbon; and a tip of the electron-emitting layer has one of a cone shape and a pyramid shape.

Also, it is preferable that the electron blocking layer is an insulating layer.

Also, it is preferable that the electron-emitting layer has resistance that is at least equal to 10 Ω·cm.

Also, it is preferable that an emission amount of electrons emitted from the electron-emitting layer arranged on the electron blocking layer is 10% or less of an emission amount of electrons emitted from the region in which the electron-emitting layer contacts the cathode electrode.

Also, it is preferable that a resistance value of a connection portion of the electron-emitting layer between a region arranged on the electron blocking layer and a region arranged on the cathode electrode is at least equal to $10^2$ Ω·cm.

Also, an electron source according to the present invention is characterized in that a plurality of electron-emitting devices are arranged therein.

It is preferable that the plurality of electron-emitting devices are wired in a matrix manner.

Also, an image-forming apparatus according to the present invention is characterized by comprising: the electron source; and a light-emitting member that emits light by irradiation of electrons emitted from the electron source

BRIEF DESCRIPTION OF THE DRAWINGS In the accompanying drawings.

DETAILED DESCRIPTION OF THE PREFERRED EMBODIMENTS

A preferable embodiment of the present invention will be exemplarily described in detail below with reference to the drawings. Note that unless otherwise specified, there is no intention to limit the scope of the present invention to the sizes, materials, shapes, relative positions, and other aspects of components described in this embodiment.

Figure 1A:
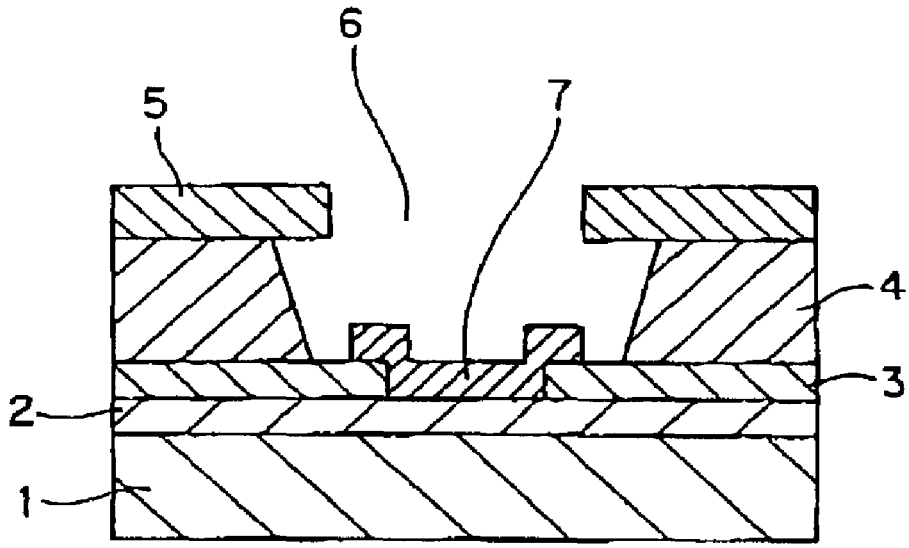
FIGS. 1A and 1B show an example of an electron-emitting device of the present invention.
Figure 1B:
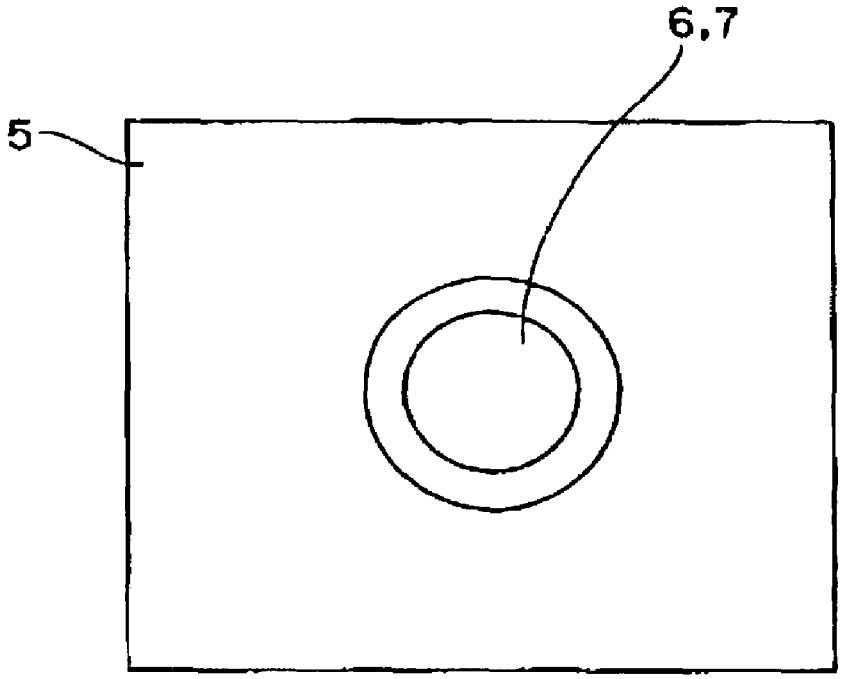
Figure 2:
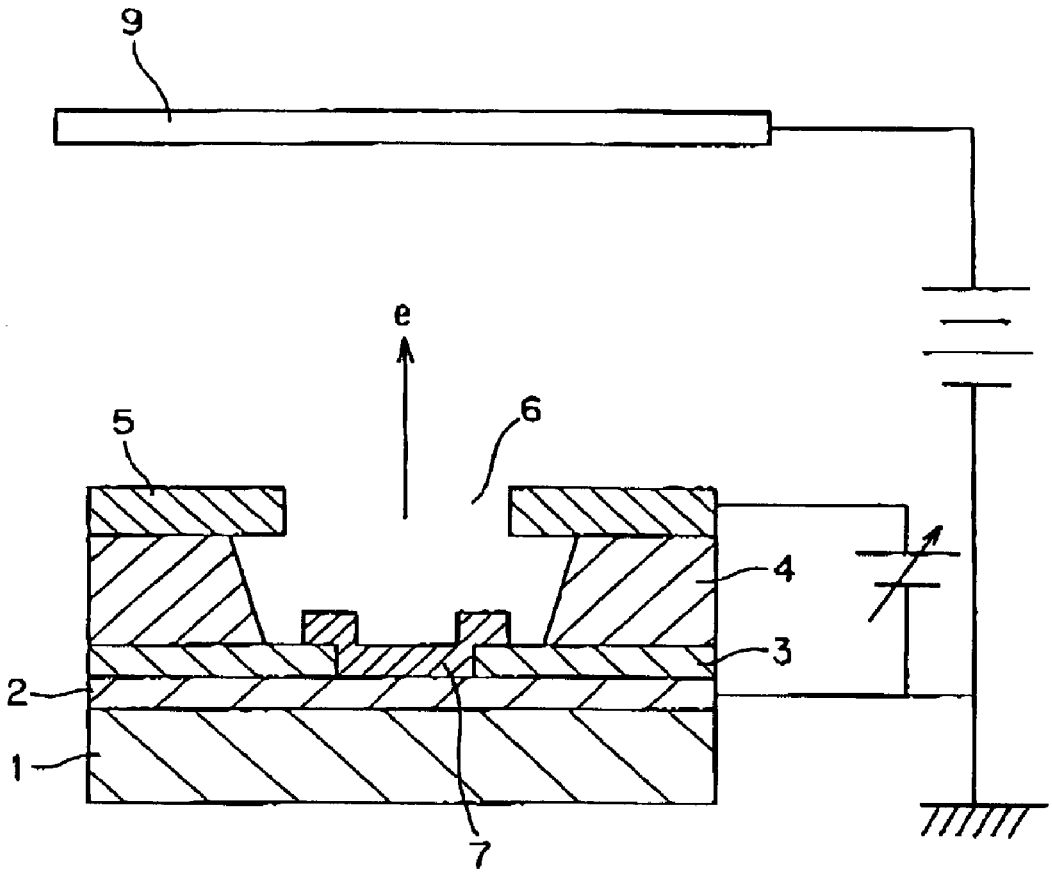
FIG. 2 shows an example of driving of the electron-emitting device of the present invention.
Figure 3A:
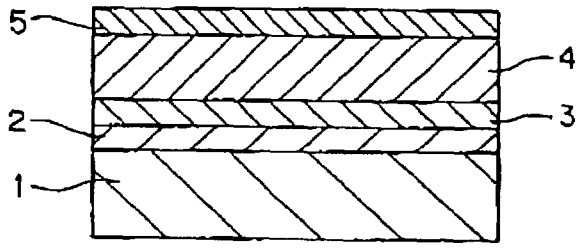
FIGS. 3A to 3D show an example method of manufacturing the electron-emitting device of the present invention.
Figure 3B:
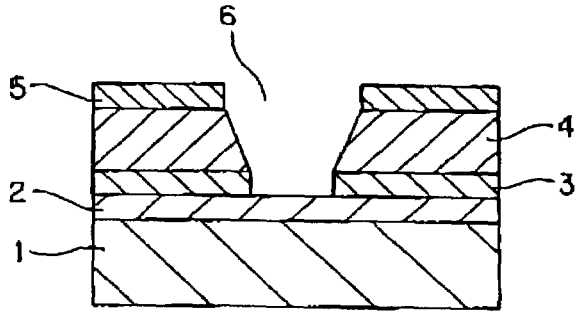
Figure 3C:
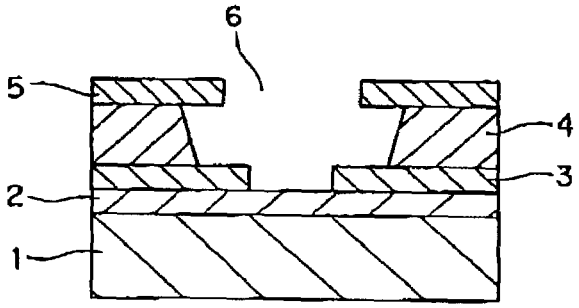
Figure 3D:
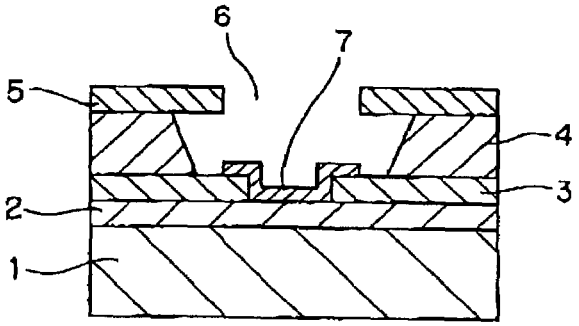
Figure 4A:
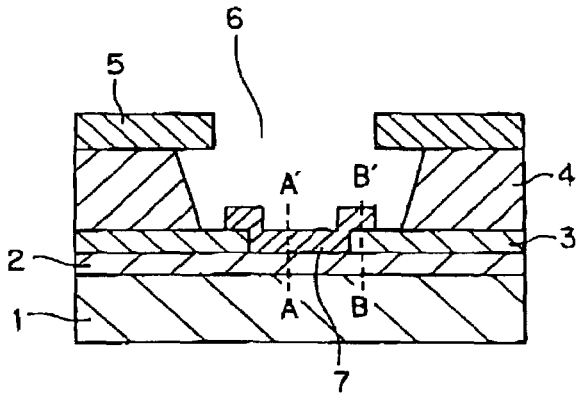
FIGS. 4A and 4B are schematic diagrams showing an electron-emitting mechanism of the electron-emitting device of the present invention.
Figure 4B:
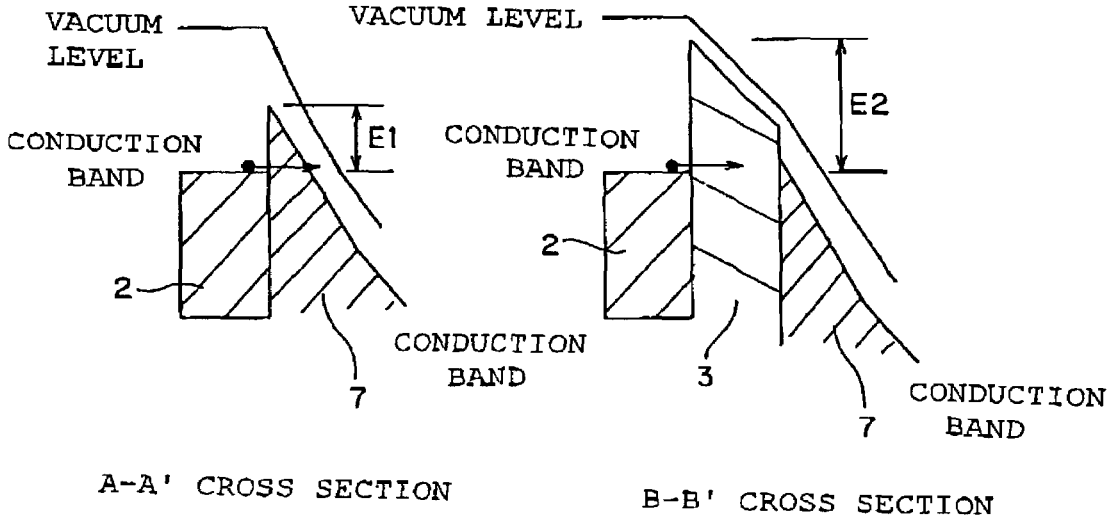

FIGS. 1A, 1B, and 2 are schematic diagrams showing an example structure of an electron-emitting device of the present invention, FIGS. 3A to 3D show an example manufacturing method of the electron-emitting device, and FIGS. 4A and 4B show a principle underlying the electron-emitting device.

First, by particularly referring to FIGS. 1A, 1B, 2, and 3A to 3D, there will be described the overall structure and manufacturing method of the electron-emitting device according to this embodiment of the present invention. FIGS. 1A and 1B are schematic diagrams of the electron-emitting device according to this embodiment of the present invention (FIG. 1A is a schematic cross-sectional view and FIG. 1B is a schematic plan view) Also, FIG. 2 is a schematic diagram of the electron-emitting device in the case where wiring has been carried out to make it possible to apply a voltage. Further, FIGS. 3A to 3D each show a step of manufacturing the electron-emitting device according to this embodiment of the present invention.

The electron-emitting device according to this embodiment mainly includes a cathode electrode 2 arranged on a substrate 1, an insulating layer 4, a gate electrode 5, an electron-emitting layer 7 (layer including an electron-emitting material) arranged on the cathode electrode 2, an electron blocking layer 3 that is partially arranged between the cathode electrode 2 and the electron-emitting layer 7, and an anode electrode 9 arranged so as to oppose these construction elements as shown in FIG. 2.

An example method of manufacturing the electron-emitting device of the present invention will be described below. Firstly, the substrate 1 is provided. The substrate 1 can use one of quartz glass, glass in which the amount of impurities like Na is reduced, soda lime glass, a lamination member configured by laminating $SiO_2$ film on a silicon substrate, or the like. An insulating substrate such as ceramics and alumina can also be used as the substrate 1. Then, the cathode electrode 2 is laminated on the substrate 1.

In general, the cathode electrode 2 has conductivity and is formed by a general technique, such as an vacuum deposition method or a sputtering method, or a photolithography technique. The material of the cathode electrode 2 is, for instance, appropriately selected from a group consisting of metals (such as Be, Mg, Ti, zr, Hf. V, Nb, Mo, W, Al, Cu, Ni, Cr, Au, Pt, and Pd) or their alloys, carbides (such as TiC, ZrC, HfC, TaC, SiC, and WC), borides (such as $HfB_2$, $ZrB_2$, $LaB_6$, $CeB_6$, $YB_4$, and $GdB_4$), nitrides (such as TiN, ZrN, and HfN), semiconductors (such as Si and Ge) carbon, and the like.

The thickness of the cathode electrode 2 is set in a range of from several ten nm to several hundred μm, and preferably in a range of from several hundred nm to several μm.

Next, the electron blocking layer 3 is deposited on the cathode electrode 2. This electron blocking layer 3 is formed with a general method such as a sputtering method, a thermal oxidization method, an anodization method, or the like. The thickness of the electron blocking layer 3 is set in a range of from several nm to several μm, and preferably in a range of from several ten nm to several hundred nm.

Further, the insulating layer 4 is deposited on the electron blocking layer 3. This insulating layer 4 is formed by a general method such as a sputtering method, a thermal oxidization method, an anodization method, or the like. The thickness of the insulating layer 4 is set in a range of from several nm to several μm, and preferably in a range of from several ten nm to several hundred nm.

Next, the gate electrode 5 is deposited on the insulating layer 4. Then a lamination member(1, 2, 3, 4, 5) is provided as shown in FIG. 3A. Like the cathode electrode 2, the gate electrode 5 has conductivity and is formed by a general technique, such as an evaporation method or a sputtering method, or a photolithography technique. The material of the gate electrode 5 is, for instance, appropriately selected from a group consisting of metals (such as Be, Mg, Ti, Zr, Hf, V, Nb, Mo, W, Al, Cu, Ni, Cr, Au, Pt, and Pd) or their alloys, carbides (such as TiC, ZrC, HfC, TaC, SiC, and WC), borides (such as $HfB_2$, $ZrB_2$, $LaB_6$,, $CeB_6$, $YB_4$, and $GdB_4$), nitrides (such as TiN, ZrN, and HfN), semiconductors (such as Si and Ge), carbon, and the like.

The thickness of the gate electrode 5 is set in a range of from several ten nm to several μm, and preferably in a range of from several ten nm to several hundred nm.

Next, as shown in FIG. 3B, with a photolithography technique, the electron blocking layer 3, the insulating layer 4, and the gate electrode 5 are partially removed from the substrate 1 in an etching step. In this manner, an opening region 6 is formed so that the cathode electrode 2 is exposed. Note that it does not matter whether this etching step is terminated before the cathode electrode 2 is also etched or is continued until the cathode electrode 2 is partially etched.

The opening region 6 formed in this step has a hole shape, a slit shape, or the like. There is selected an appropriate shape in accordance with a required beam shape, driving voltage, and the like. The size of the opening region is selected from an optimum range in accordance with a required beam size, driving voltage, and the like and is set in a range of from several nm to several ten μm.

Next, an etching step for further removing the side walls of the insulating layer 4 is performed as shown in FIG. 3C. In this step, for instance, there may be performed an etching operation that uses a solution such as a hydrofluoric acid solution. Aside from this, there may be selected a condition under which isotropic etching is performed using plasma. Also, in the step of establishing an opening in the gate electrode, by optimally setting an etching condition, it becomes possible to omit the step of etching the side walls of the insulating layer during the aforementioned step of establishing an opening in the gate electrode.

Figure 12:
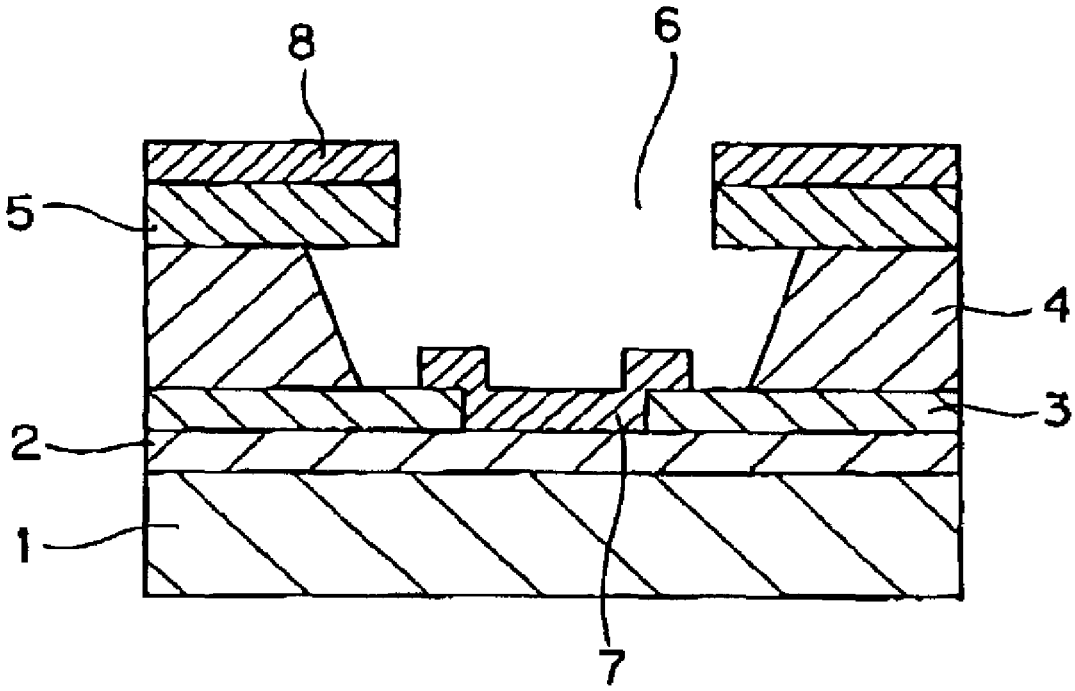
FIG. 12 shows an example of the electron-emitting device of the present invention.

Finally, the electron-emitting layer 7 is deposited within the opening region 6 as shown in FIG. 3D. During this operation, it does not matter whether a material for forming the electron-emitting layer 7 exists only within the opening region 6 or also coats the gate electrode 5 as shown in FIG. 12.

Also, the present invention is not limited to the form described above that has an opening region. That is, the present invention is preferably applicable to a structure shown in FIG. 13 where the cathode electrode 2 is arranged over the gate electrode 5 with the insulating layer 4 therebetween.

Here, in the case where a high-definition electron-emitting device is realized, it is required to use a device structure where it is possible to control an electron beam and to converge the beam. However, in an electron-emitting device produced with a conventional technique, when a voltage is applied to the device for driving so that electrons are emitted from the electron-emitting device, some of the electrons travel along an electric field formed in the vicinity of an electron-emitting region. As a result, it is difficult to converge an electron beam.

The present invention solves the problem described above and realizes a high-definition electron-emitting device. As to the electron-emitting device of the present invention, its mechanism for emitting electrons will be described in detail below with reference to FIGS. 4A, 4B, and 5.

Figure 5:
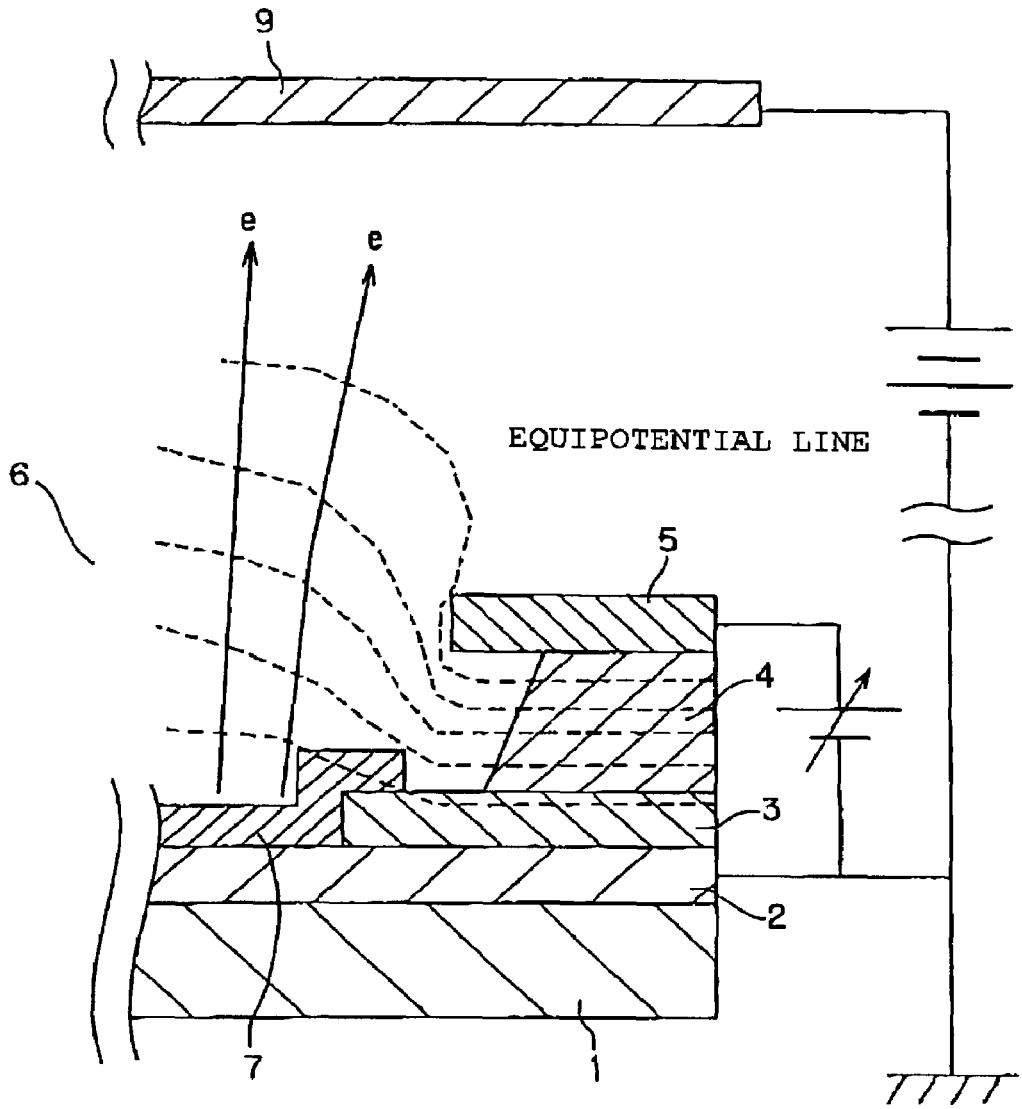
FIG. 5 shows an electron trajectory of the electron-emitting device of the present invention.

FIGS. 4A and 4B show a state where electrons are transported in the case where the electron-emitting device of the present invention is actually driven, while FIG. 5 shows a state where electrons are emitted into a vacuum.

FIG. 4A is a cross-sectional view of a region, in which electrons are emitted, and a region, in which no electron is emitted, of the electron-emitting layer 7 of the electron-emitting device of the present invention. Also, FIG. 4B shows schematic diagrams that illustrate a process of transporting electrons from the cathode electrode 2 to the electron-emitting layer using an energy band diagram and are the equivalent of cross-sectional views taken along the lines A-A' and B-B' in FIG. 4A.

In the electron-emitting device of the present invention, as shown in FIG. 4B, in the region in which electrons are emitted, electrons are injected from the cathode electrode 2 to the electron-emitting layer. consequently, the electrons are discharged into a vacuum.

On the other hand, in the region in which there is inserted the electron blocking layer 3 and no electron is emitted, before electrons are transported from the cathode electrode 2 to the electron-emitting layer 7, there exists a large energy barrier in comparison with the electron-emitting layer 7 and therefore the injection of electrons from the cathode electrode into the electron-emitting layer is inhibited by this barrier. As a result, it becomes possible to form a region in which electron emission does not occur.

Further, in order to effectively prevent a situation where electrons are emitted from the electron-emitting layer arranged on the electron blocking layer, in the electron-emitting film of the present invention, it is required that no free electron exists in a conduction band of the electron-emitting layer (there exists no electron other than the electrons injected from the cathode electrode) at room temperature. That is, the electron-emitting film of the present invention is at least constructed of a non-metallic substance. As a result, it is preferable that the electron-emitting film of the present invention has an energy gap that is at least equal to 0.3 eV between the Fermi level and the conduction band. This is because if the energy gap is smaller than this value, free electrons easily exist in the conduction band at room temperature (300K). By using an electron-emitting film having a structure like this, it becomes possible to effectively suppress electron emission from the electron-emitting film existing on the electron blocking layer.

As to the electron-emitting device of the present invention, because of the electron-emitting mechanism described above, the material of the electron-emitting layer described above is selected from materials having a positive energy band gap. As concrete examples of the materials of the electron-emitting film, there may be cited Si, SiC, and the like. However, it is preferable that there is used diamond, diamond like carbon, amorphous carbon, or the like that are known as low electric field electron-emitting materials.

Also, as to the electron-emitting film of the present invention, aside from the structure described above, there may be used a structure where the electrons injected from a region, which directly contacts the cathode electrode, to the electron-emitting layer do not move to the electron-emitting film on the electron blocking layer or, even it the electrons move, the electrons are not effectively emitted from the electron-emitting film on the electron blocking layer. The present invention is not limited to the materials described above and it is possible use other materials so long as a structure like this is used. In more detail, it is sufficient that the amount of electrons emitted from the electron-emitting film arranged on the electron blocking layer is suppressed so as to become 10% or less of the amount of electrons emitted from the region that directly contacts the cathode electrode. To do so, in more detail, it is sufficient that the resistance of the electron-emitting film is set at 10 Ω·cm or higher. Alternatively, it is also sufficient that high resistance effectively exists in a boundary region between a partial region of the electron-emitting film, which directly contacts the cathode electrode, and a region of the electron-emitting film that exists on the electron blocking layer. In more detail, it is sufficient that the resistance of the boundary region is at least equal to $10^2$ Ω·cm.

By using the electron-emitting film described above, if the electron-emitting device of the present invention is actually driven in a manner shown in FIG. 5, it becomes possible to prevent electron discharge in a region, in which the electron blocking layer is formed, and to realize the convergence of an electron beam. In particular, a region in the vicinity of a region, in which the electron blocking layer described above is formed, is a region in which an electric field is greatly changed due to the device structure and the prevention of electron emission is effective at converging an electron beam.

Also, the electron blocking layer of the electron-emitting device of the present invention is a layer for effectively preventing the injection of electrons from the cathode electrode 2 to the electron-emitting layer 7. Consequently, the material of the electron blocking layer is selected so that the energy barrier formed at an interface between the cathode electrode and the electron blocking layer becomes larger than an energy barrier formed at an interface between the cathode electrode and the electron-emitting layer. For instance, the material is selected from a group consisting of insulating materials, such as $SiO_2$ and SiNx, and semiconductor materials.

Figure 6:
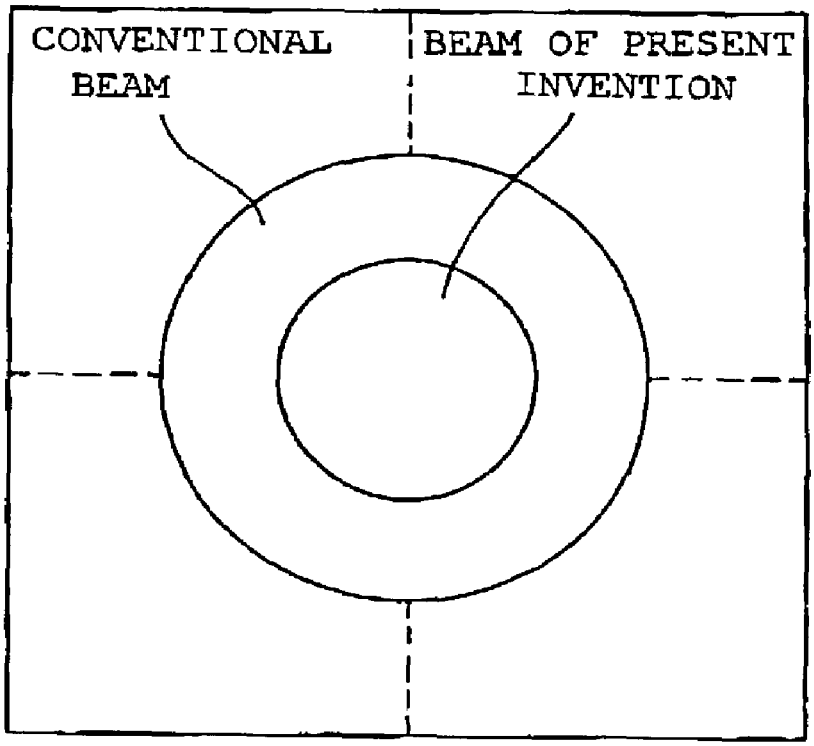
FIG. 6 shows an electron beam of the present invention.

As a result, as shown in FIG. 6, the electron-emitting device of the present invention makes it possible to realize the convergence of an electron beam in comparison with a conventional electron-emitting device in which no electron blocking layer exists.

Figure 7:
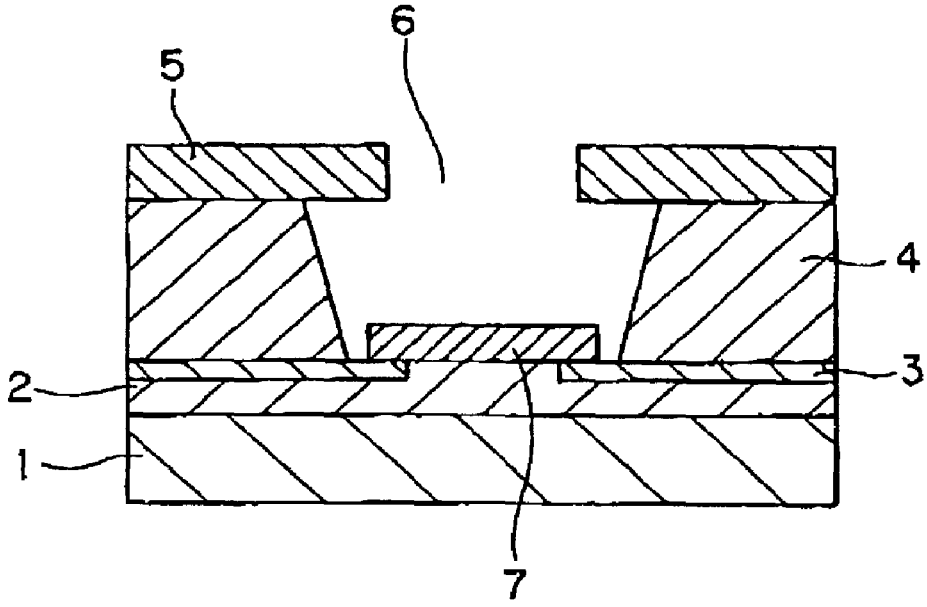
FIG. 7 shows an example of the electron-emitting device of the present invention.

In the electron-emitting device of the present invention, the convergence of an electron beam is realized by inserting the electron blocking layer between the cathode electrode and the electron-emitting layer. As a result, for instance, there may be used a structure where a part of the surface of the cathode electrode is formed using an insulating layer as shown in FIG. 7.

Figure 8:
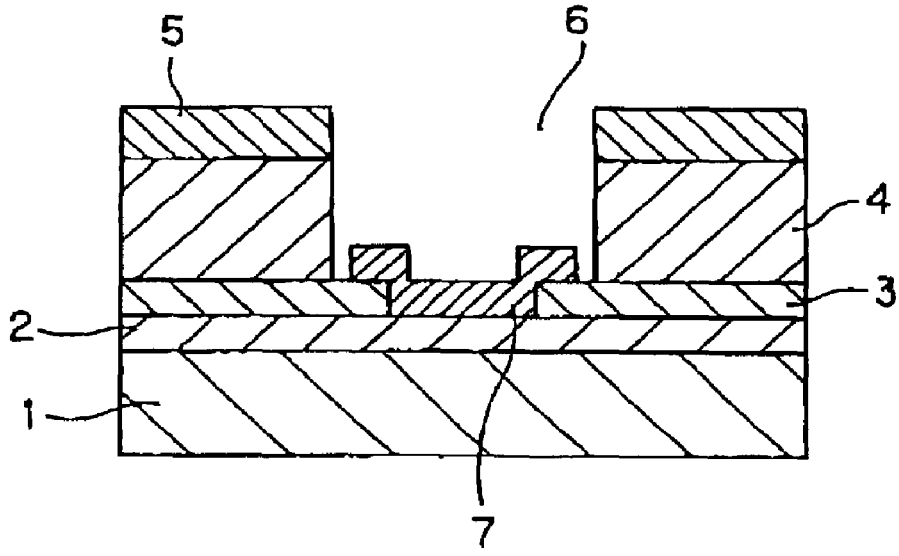
FIG. 8 shows an example of the electron-emitting device of the present invention.

Also, as shown in FIG. 8, there may be used a structure where the side walls of the insulating layer within the opening region 6 are not removed.

Figure 9:
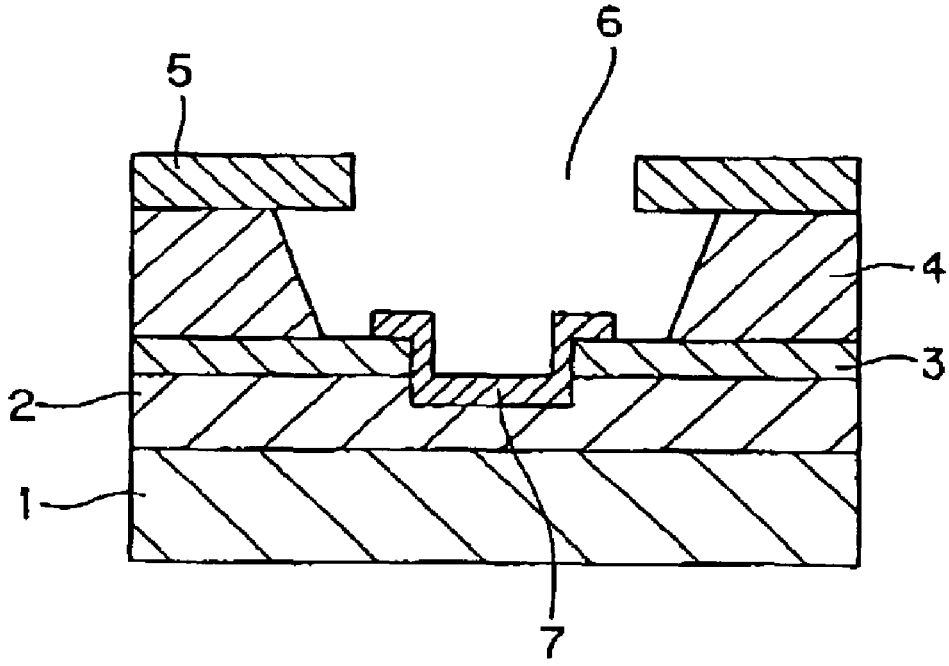
FIG. 9 shows an example of the electron-emitting device of the present invention.
Figure 10:
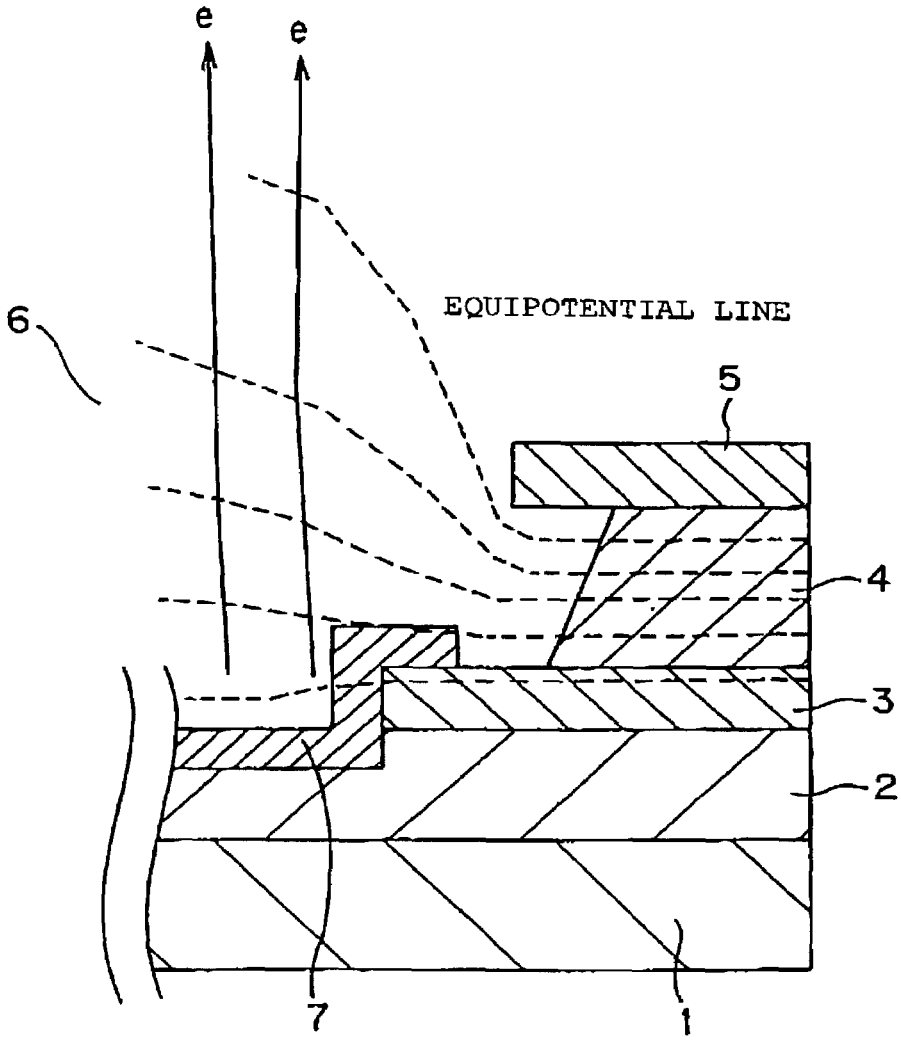
FIG. 10 shows an electron trajectory in the case of the device structure shown in FIG. 9.

Also, as shown in FIG. 9, by obtaining a structure where the surface of the cathode electrode within the opening region 6 is concaved, it becomes possible to control the distribution of an electric field within the opening region 6 as shown in FIG. 10. As a result, it becomes possible to obtain a device structure that further converges an electron beam.

Figure 11:
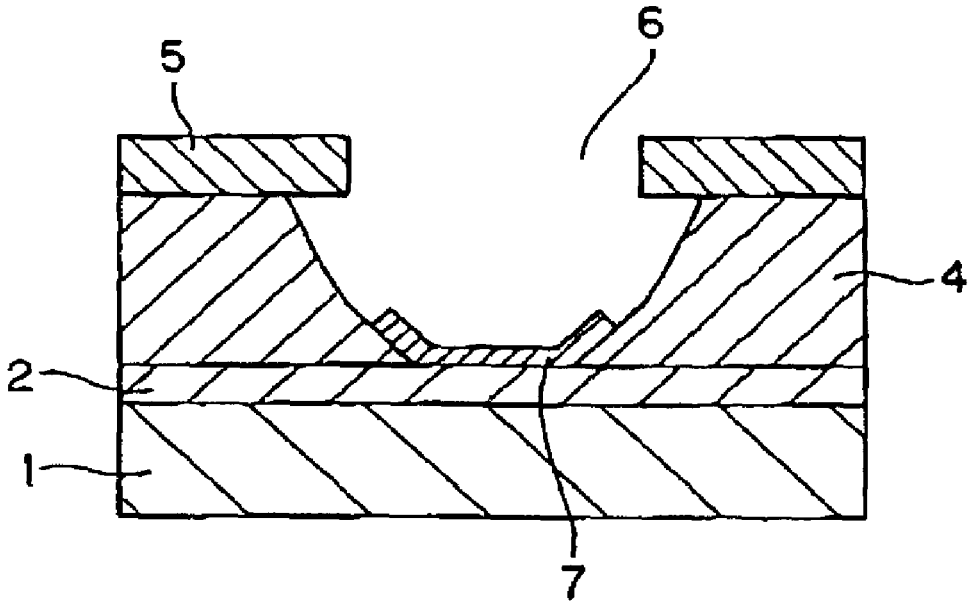
FIG. 11 shows an example of the electron-emitting device of the present invention.

Further, as shown in FIG. 11, in the case where the insulating layer is removed in an inclined manner, for instance, there is obtained a structure where the electron-emitting layer partially overlaps the insulating layer. With this structure, it becomes possible to use the insulating layer as the electron blocking layer.

In the structure examples of the electron-emitting layer device that have been described above, there may be used a structure where the surface of the gate electrode is coated with a material that is the same as the material of the electron-emitting layer, as shown in FIG. 12. In this case, it becomes possible to use the coat as a protective layer of the gate electrode or the like.

Figure 18:
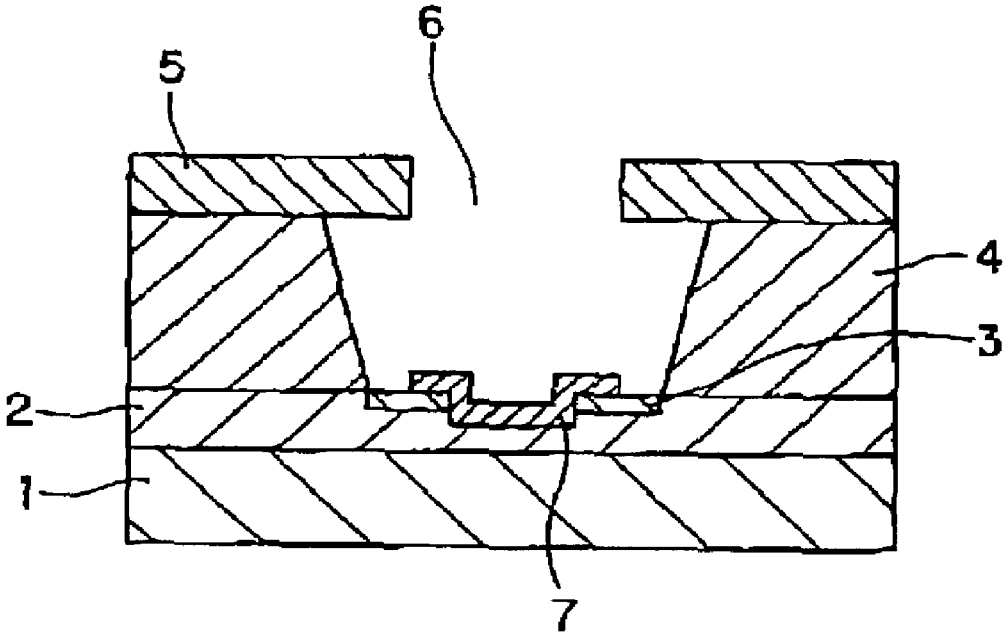
FIG. 18 shows an example of the electron-emitting device of the present invention.

Also, as shown in FIG. 18, there may be used a structure where only an exposed region of the surface of the cathode electrode within the opening region 6 described above is selectively oxidized, the oxidized layer is partially removed, and then the electron-emitting layer 7 is arranged.

Further, in the present invention, a material having a sharp-pointed tip or carbon fibers may be used as the electron emitting layer 7. As the carbon fibers, there are preferably used carbon nanotubes (fibers that each have a cylindrical graphene that surrounds the axis of a fiber (single-wall carbon nanotubes)), and multi-wall carbon nanotubes (fibers that each have a plurality of cylindrical graphenes that surround the axis of a fiber), or graphitic nanofibers (fibers having graphemes stacked not-parallel to the axial direction of the fibers) Among these carbon fibers, it is particularly preferable that the graphitic nanofibers are used because it becomes possible to obtain large emission currents. Also, the carbon fibers described above include carbon nanocoils whose carbon fibers have a coil shape.

Figure 19:
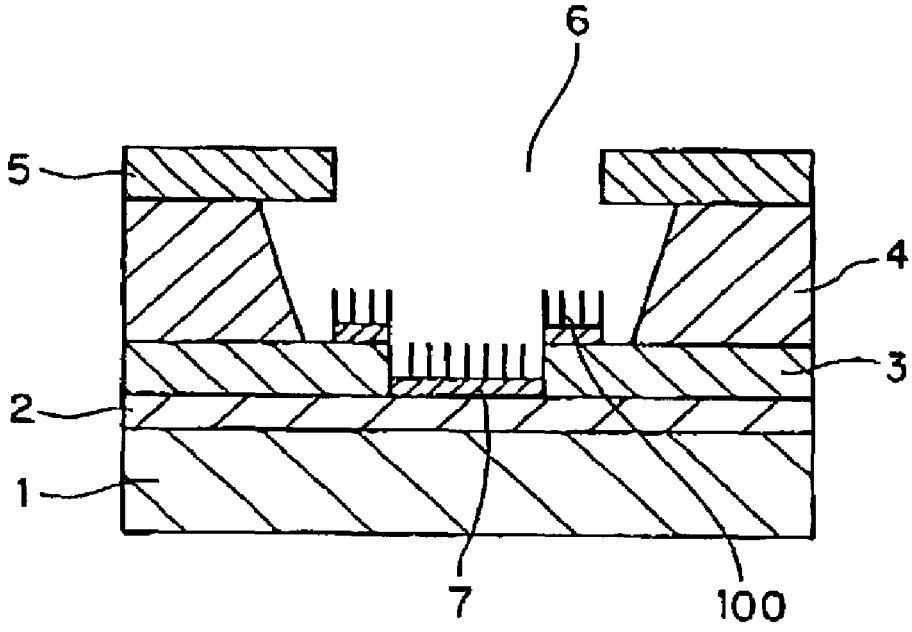
FIG. 19 shows an example of the electron-emitting device of the present invention.
Figure 20:
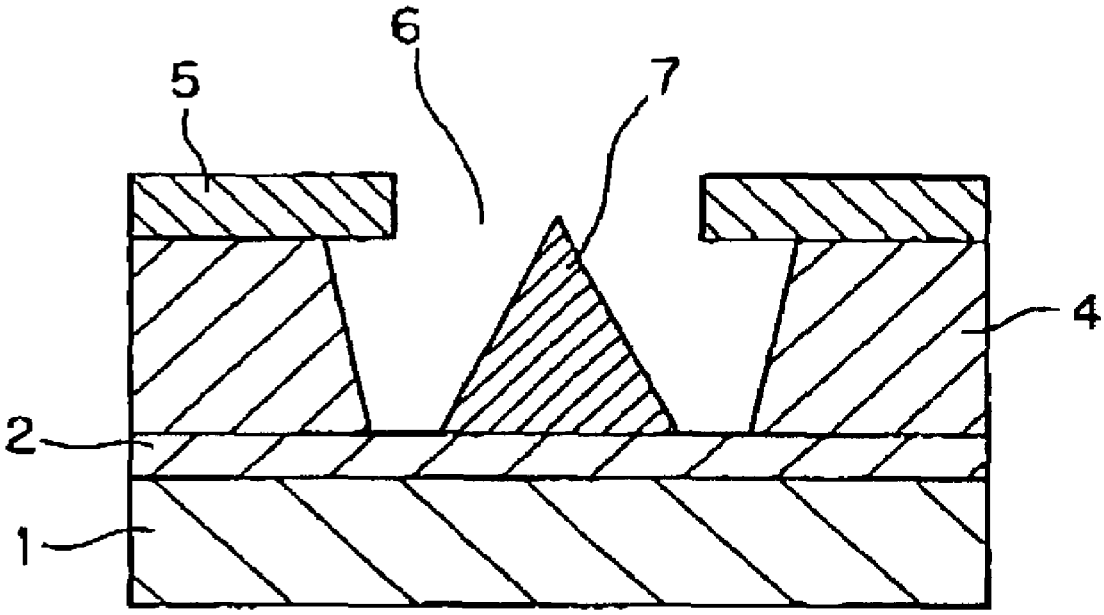
FIG. 20 is a schematic diagram showing a conventional electron-emitting device.
Figure 21:
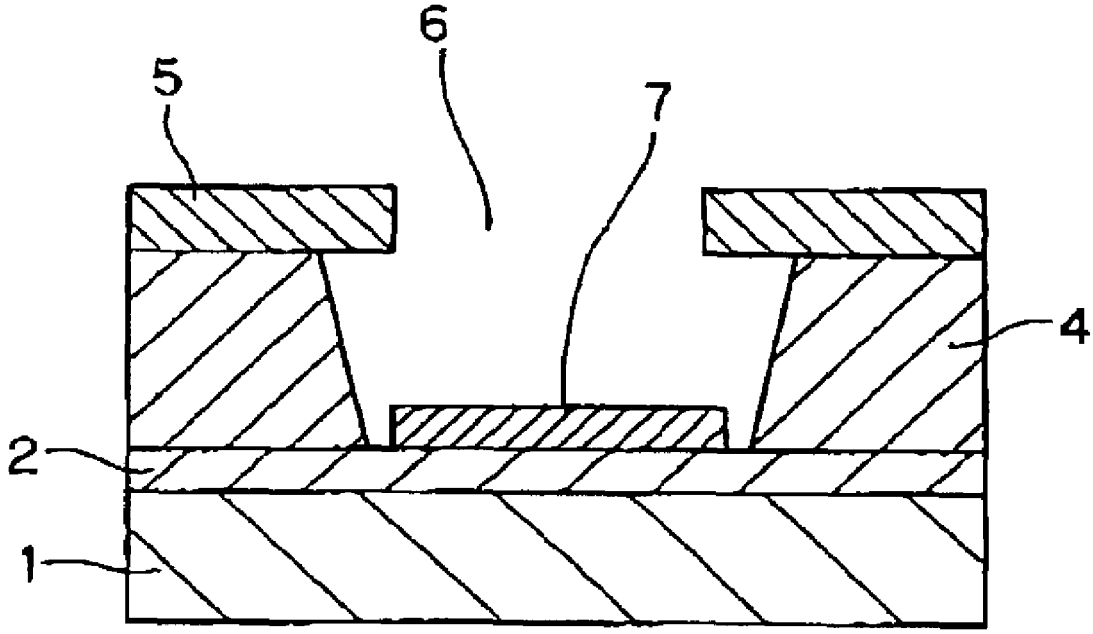
FIG. 21 is a schematic diagram showing another conventional electron-emitting device.
Figure 22:
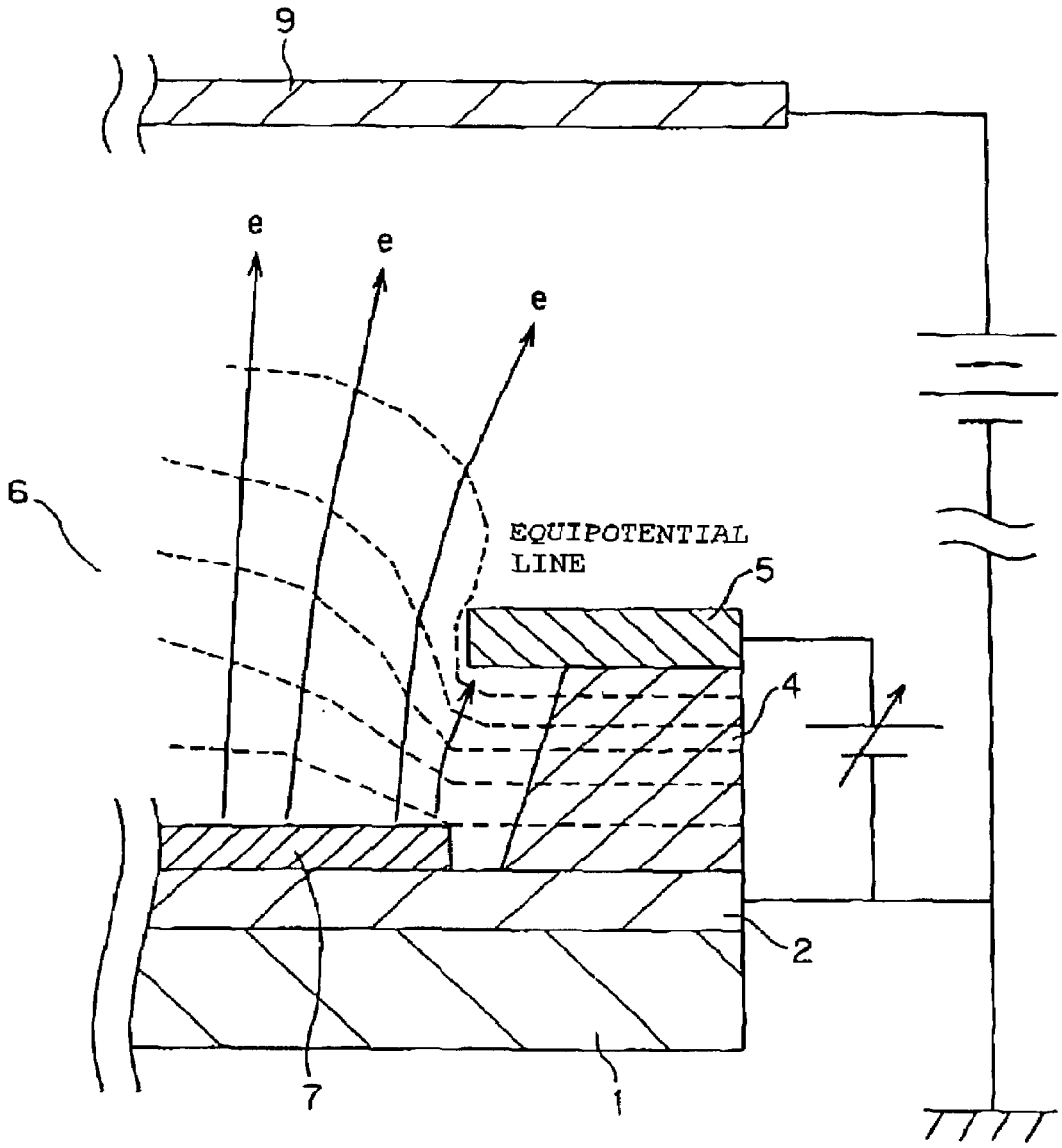
FIG. 22 is a schematic diagram showing an electron trajectory of the conventional electron-emitting device.
Figure 23:
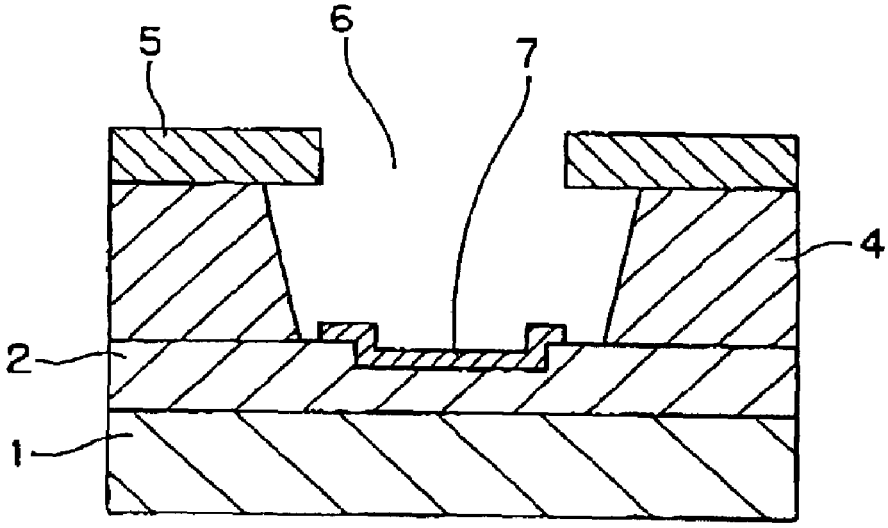
FIG. 23 is a schematic diagram showing still another conventional electron-emitting device.

In that case, for instance, firstly a catalytic particles are disposed on the cathode electrode 2. Then, the above-mentioned carbon fibers grows from a catalyst particle by CVD method. Consequently, the electron-emitting layer 7 including the carbon fibers 100 may be disposed as shown in FIG. 19.

Next, there will be described an example where the electron-emitting device is applied to an image-forming apparatus.

Figure 14:
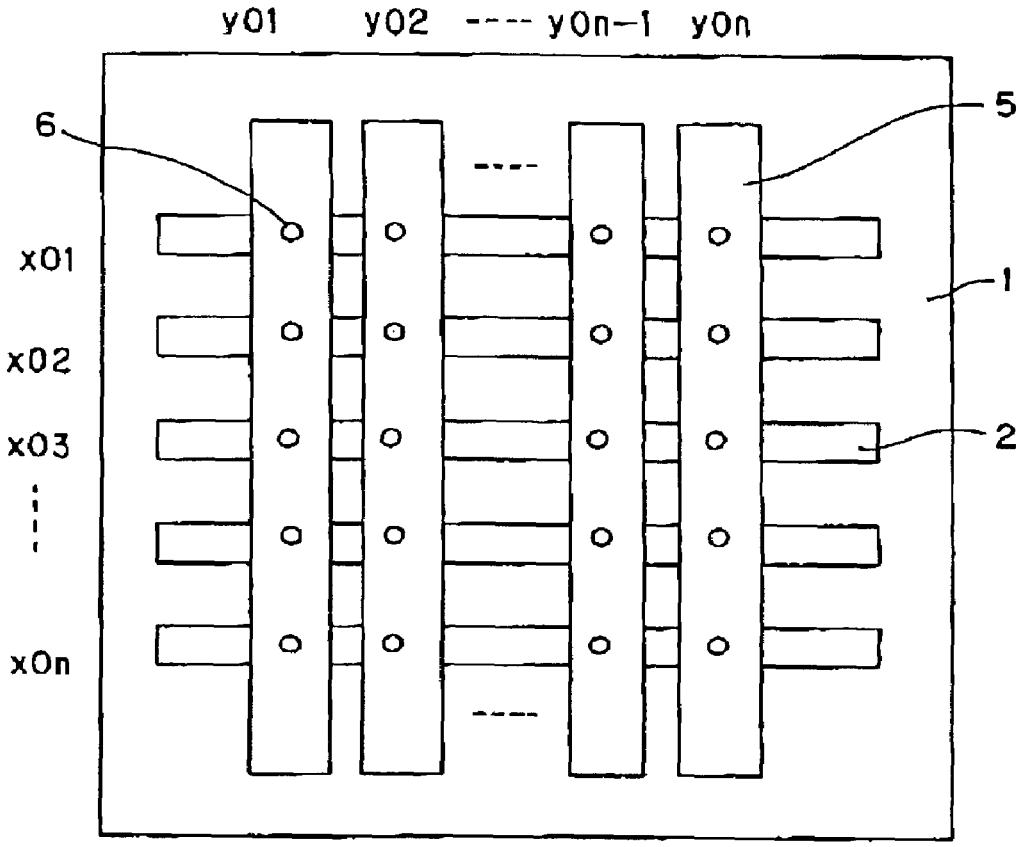
FIG. 14 is a schematic drawing in which the electron-emitting devices of the present invention are arranged in a matrix manner.

FIG. 14 shows an embodiment of a state where a plurality of electron-emitting devices of the present invention are arranged in a matrix manner.

Figure 15:
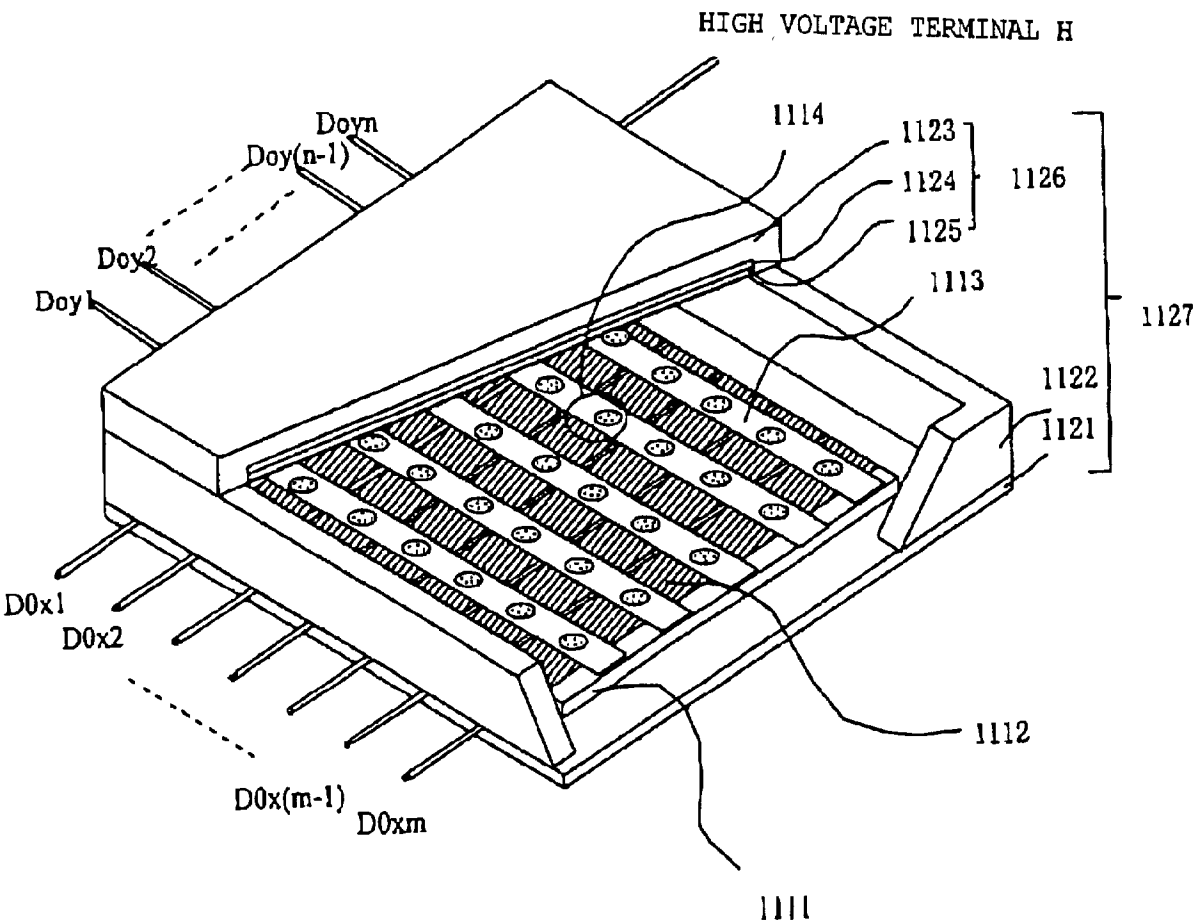
FIG. 15 is a schematic diagram in which an image-forming apparatus is formed using the electron-emitting devices of the present invention.

Also, an image-forming apparatus 1127 obtained by arranging a plurality of electron-emitting devices, to which the present invention is applicable, will be described with reference to FIG. 15. In FIG. 15, reference numeral 1111 denotes an electron source substrate, numeral 1112 X-directional wiring, and numeral 1113 Y-directional wiring. Also, reference numeral 1114 denotes an electron-emitting device of the present invention.

In FIG. 15, the X-directional wiring 1112 includes m lines (DX1, DX2, . . . , DXm) and is formed using an aluminum-based wiring material obtained with an evaporation method to have a thickness of around 1 μm and width of 300 μm. The material, thickness, and width of the wiring are determined as appropriate. The Y-directional wiring 1113 includes n lines (DY1, DY2, . . . , DYn) and is formed in the same manner as the X-directional wiring 1112 to have a thickness of 0.5 μm and a width of 100 μm. An unillustrated interlayer insulating layer having a thickness of around 1 μm is provided between the X-directional wiring 1112 including the m lines and the Y-directional wiring 1113 including the n lines so as to electrically separate these wirings (m and n are each a positive integer)

In addition, in FIG. 15, reference numeral 1121 denotes a first plate, numeral 1122 denotes a support plate, and numeral 1123 denotes of second plate.

The unillustrated interlayer insulating layer is an insulating layer formed with a sputtering method or the like. For instance, the interlayer insulating layer having a desired shape is formed to cover the entire or a part of the surface of the substrate 1111 on which the X-directional wiring 1112 has been formed. In particular, the thickness, material, and production method of the interlayer insulating layer are determined as appropriate so that the interlayer insulating layer is resistant to potential differences at intersections of the X-directional wiring 1112 and the Y-directional wiring 1113. The X-directional wiring 1112 and the Y-directional wiring 1113 are respectively routed to the outside as external terminals.

Each electrode (not shown) constituting the electron-emitting device 1114 of the present invention is electrically connected to each of the m lines of the X-directional wiring 1112 and then lines of the Y-directional wiring 1113 by connection wiring (not shown) formed using a conductive metal or the like.

To the X-directional wiring 1112, there is connected an unillustrated scanning signal applying means for applying a scanning signal to select a row of the electron-emitting devices 1114 of the present invention arranged in an X direction. On the other hand, to the Y-directional wiring 1113, there is connected an unillustrated modulation signal generating means for modulating each column of the electron-emitting devices 1114 of the present invention arranged in the Y direction in accordance with an input signal. The driving voltage applied to each electron-emitting device is supplied as a differential voltage between the scanning signal and modulation signal applied to the device. In the present invention, connection is carried out so that the Y-directional wiring has a high potential and the X-directional wiring has a low potential. By performing connection in this manner, there is obtained an effect of converging a beam.

The above-mentioned structure makes it possible to select respective electron-emitting devices and independently drive the selected devices using passive matrix wiring.

It is possible to form an image-forming apparatus whose display panel is constructed using an electron source having a passive matrix arrangement like this.

It should be noted here that in an image-forming apparatus that uses the electron-emitting devices of the present invention, phosphors are aligned and arranged above the devices by giving consideration to the trajectory of emitted electrons.

Figure 16A:
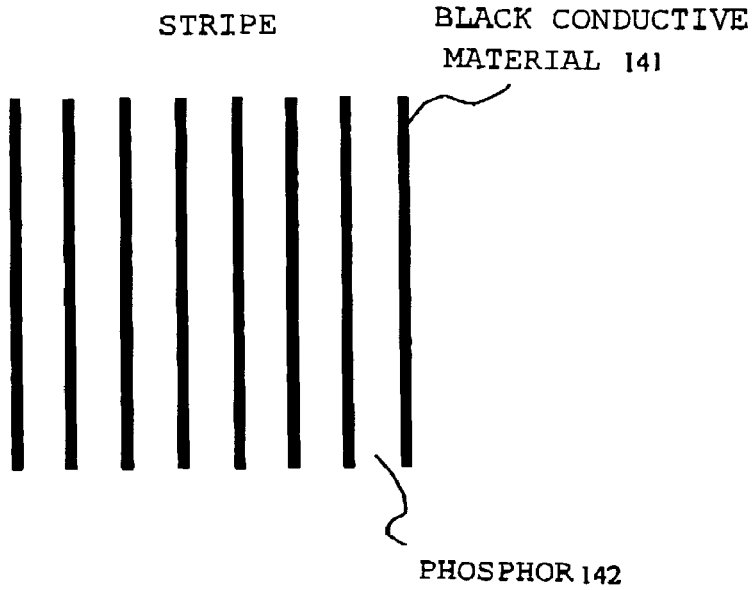
FIGS. 16A and 16B are schematic diagrams that each show an example of a phosphor used in the image-forming apparatus.
Figure 16B:
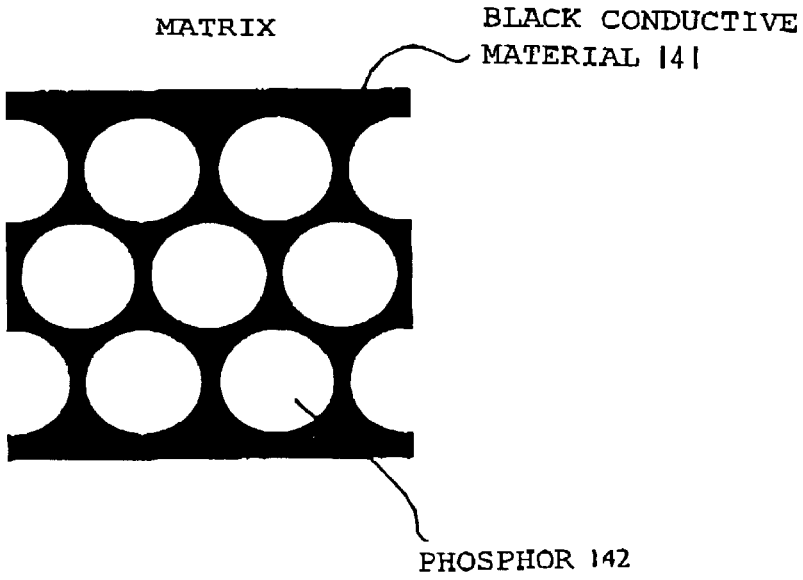

FIGS. 16A and 16B are each a schematic diagram showing a phosphor film used in this panel.

In the case of a color phosphor film, the phosphor film is constructed of a black conductive material 141 and a phosphor 142. The black conductive material 141 is called a black stripe when the phosphor is arranged in the manner shown in FIG. 16A, and is called a black matrix when the phosphor is arranged in the manner shown in FIG. 16B.

The black stripe or the black matrix is provided to blacken the boundaries among respective phosphors 142 for the three primary colors required to display a color image, thereby preventing the striking of color mixture or the like and suppressing the lowering of contrast due to the reflection of external light by the phosphor film 142.

As the material of the black strip, in this embodiment, there is used a material whose main ingredient is black lead that is usually used.

In FIG. 15, in usual cases, a metal back 1125 is provided on the internal surface side of the phosphor film 1124.

The metal back is formed by subjecting the inner surface of the phosphor film to a smoothing process (usually called "filming") after the phosphor film has been formed, and then by depositing Al using a vacuum evaporation method or the like.

The face plate 1126 may be provided with a transparent electrode (not shown) on the outer surface side of the phosphor film 1124 to further enhance the conductivity of the phosphor film 1124.

In the case of color display, during the seal bonding of the panel, it is required to have phosphors in respective colors correspond to electron-emitting devices, which means that sufficient positional registration is indispensable.

In this embodiment, corresponding phosphors are arranged immediately above an electron source.

Figure 17:
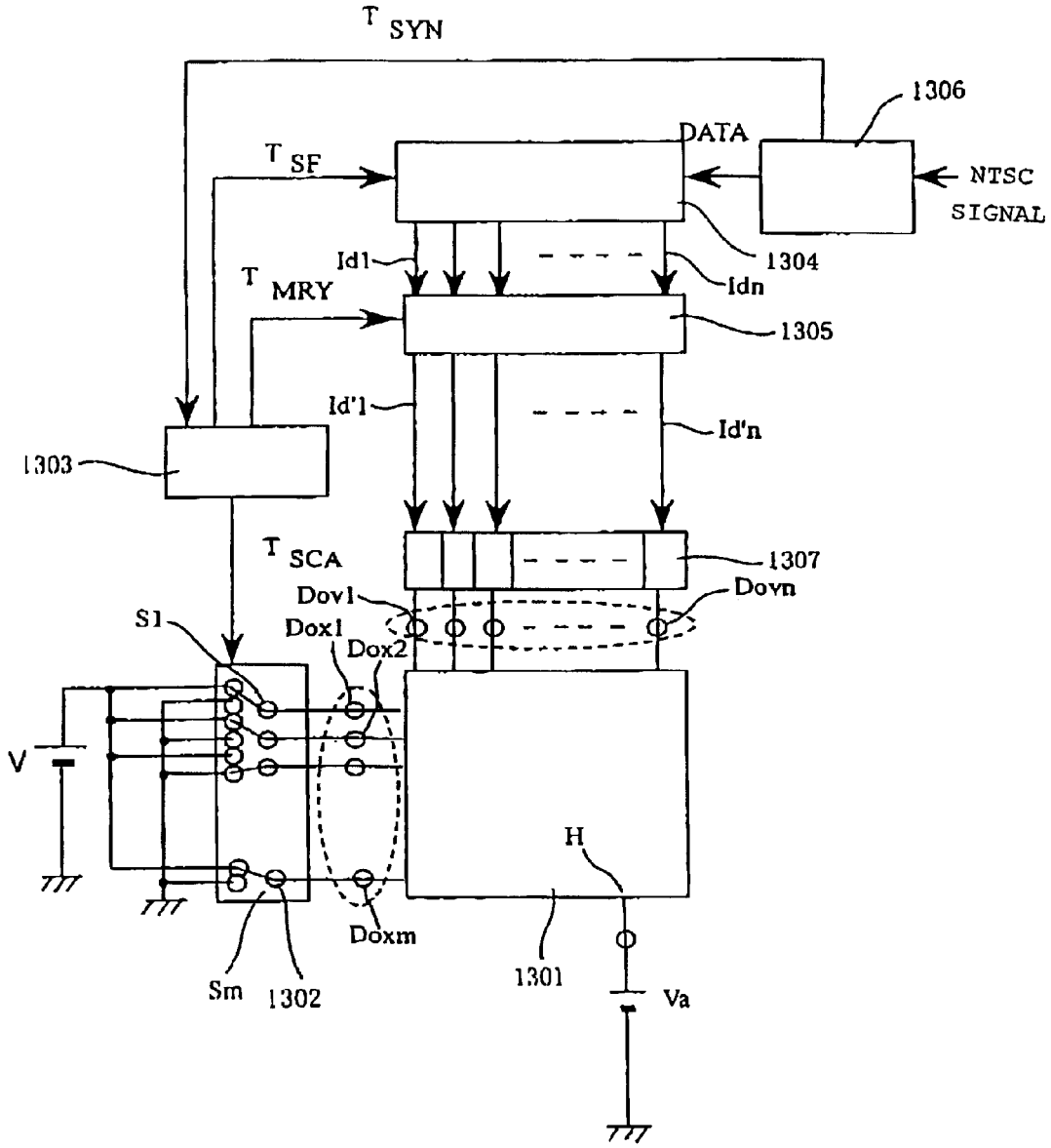
FIG. 17 is a schematic diagram in which an image-forming apparatus is formed using the electron-emitting devices of the present invention.

A scanning circuit shown in FIG. 17 will be described below. This circuit includes therein M switching devices (schematically shown in the drawing using reference symbols S1 to Sm) Each of the switching devices selects one of an output voltage from a DC voltage source Vx and 0 [V] (ground level) and is electrically connected to one of the terminals Dx1 to Dxm of a display panel 1301. Each of the switching devices S1 to Sm operates based on a control signal Tscan outputted from a control circuit 1303. For instance, the switching devices can be constructed by combining switching devices such as FETs.

In this example, the DC voltage source Vx is set based on a characteristic (electron-emitting threshold voltage) of the electron-emitting device of the present invention so that there is outputted a constant voltage with which a driving voltage not exceeding the electron-emitting threshold voltage is applied to each device that is not scanned.

The control circuit 1303 has a function of establishing matching between operations of respective portions so that an appropriate display operation is performed based on an image signal inputted from the outside. On the basis of a synchronizing signal Tsync sent from a synchronizing-signal separation circuit 1306, the control circuit 1303 generates respective control signals Tscan, Tsft, and Tmry and supplies these control signals to respective portions.

The synchronizing-signal separation circuit 1306 is a circuit for separating an NTSC television signal inputted from the outside into a synchronizing signal component and a luminance signal component. It is possible to construct this circuit using a general frequency separation (filter) circuit or the like. The synchronizing signal separated by the synchronizing-signal separation circuit 1306 consists of a vertical synchronizing signal and a horizontal synchronizing signal. To simplify the description, however, the synchronizing signal is illustrated as a Tsync signal in the drawing. Also, the luminance signal component of an image separated from the television signal is expressed as a DATA signal for ease of explanation. The DATA signal is inputted into a shift register 1304.

The shift register 1304 serial/parallel-converts the DATA signal serially inputted in a time series manner for each line of an image, and operates based on the control signal Tsft sent from the control circuit 1303 (that is, the control signal Tsft may be regarded as a shift clock signal for the shift register 1304). Data for one line of the image (corresponding to data for driving N electron-emitting devices), which has been serial/parallel converted, is outputted from the shift register 1304 as N parallel signals Id1 to Idn.

A line memory 1305 is a storage device for storing, for a required time, data for one line of the image. The line memory 1305 stores contents of Id1 to Idn in accordance with the control signal Tmry sent from the control circuit 1303 as appropriate. The stored contents are outputted as Id'1 to Id'n and are inputted into a modulation signal generator 1307.

The modulation signal generator 1307 is a signal source for appropriately driving and modulating each electron-emitting device of the present invention in accordance with each of image data Id'1 to Id'n. An output signal from the modulation signal generator 1307 is applied, through the terminals Dox1 to Doyn, to the electron-emitting devices of the present invention in the display panel 1301.

As described above, the electron-emitting devices, to which the present invention is applicable, have the following basic characteristic with reference to an emission current Ie. That is, there exists a clear threshold voltage Vth for electron emission and, only when a voltage that is at least equal to Vth is applied, there occurs electron emission. As to the voltage that is at least equal to the electron-emitting threshold value, an emission current also changes in accordance with changes of a voltage applied to the devices. From this, in the case where a pulse-shaped voltage is applied to these devices, even if there is applied a voltage that does not exceed the electron-emitting threshold value, for instance, no electron is emitted. However, in the case where a voltage that is at least equal to the electron-emitting threshold value is applied, an electron beam is outputted. By changing a peak value Vm of the pulse during this operation, it becomes possible to control the intensity of the electron beam to be outputted. Also, by changing the width Pw of the pulse, it becomes possible to control the total quantity of electric charges of the electron beam to be outputted.

Accordingly, the electron-emitting device can be modulated in accordance with an input signal using a voltage modulation method, a pulse-width modulation method, or the like. In the case where the voltage modulation method is employed, the modulation signal generator 1347 may be a voltage modulation circuit that generates a voltage pulse having a constant length and appropriately modulates the peak value of the pulse in accordance with the inputted data.

In the case where the pulse-width modulation method is employed, the modulation signal generator 1307 may be a pulse-width modulation circuit that generates a voltage pulse having a constant peak value and appropriately modulates the width of the voltage pulse in accordance with the inputted data.

The shift register and line memory may be of a digital signal type or an analog signal type so long as it is possible to perform the serial/parallel conversion and storage of an image signal at a predetermined speed.

In the case where the digital signal type components are employed, the output signal DATA from the synchronizing-signal separation circuit 1306 must be converted into a digital signal. It is possible to perform this conversion by providing an A/D converter for the output portion of the synchronizing-signal separation circuit 1306. In relation to this, the circuit to be used as the modulation signal generator 1307 is somewhat changed depending on whether the output signal from the line memory 1305 is a digital signal or an analog signal. That is, in the case of the voltage modulation method using a digital signal, D/A conversion circuit or the like is used for the modulation signal generator 1307, and an amplifying circuit and the like are added as necessary. In the case of the pulse-width modulation method, the modulation signal generator 1307 is constructed using a circuit formed by combining, for instance, a high-speed oscillator, a counter for counting the number of waves outputted from the oscillator, and a comparator for comparing an output value from the counter and an output value from the aforementioned memory. As the need arises, an amplifier may be added which amplifies the voltage of the modulation signal, which has been outputted from the comparator and whose pulse width has been modulated, to a voltage for driving the electron-emitting device of the present invention.

In the case of the voltage modulation method using an analog signal, an amplifying circuit including an operational amplifier or the like may be employed as the modulation signal generator 1307. As the need arises, a level shift circuit or the like may be added. In the case of the pulse-width modulation method, a voltage control oscillation circuit (VCO) may be employed, for instance. As the need arises, an amplifier may be added which amplifies the voltage to the voltage for driving the electron-emitting device of the present invention.

The structure of the image-forming apparatus described above is merely an example of the image-forming apparatus to which the present invention is applicable. Therefore, various modifications may be made based on the technical idea of the present invention. Although the NTSC input signal has been described, the input signal is not limited to this signal. Another method, such as PAL or SECAM, may be employed. Also, another television signal method using a larger number of scanning lines (for instance, a high-quality television method typified by the MUSE method) may be employed.

Also, aside from the display apparatus, for instance, the image-forming apparatus of the present invention may be used as an image-forming apparatus functioning as an optical printer constructed using a photosensitive drum and the like.

Embodiments

Embodiments of the present invention will be described in detail below.

First Embodiment

FIGS. 1A and 1B are respectively an example cross-sectional view and an example plain view of an electron-emitting device produced with the technique of this embodiment, while FIGS. 3A to 3D show an example method of manufacturing the electron-emitting device of the present invention. The steps of manufacturing the electron-emitting device of this embodiment will be described in detail below.

The substrate 1 is prepared by sufficiently cleaning quartz. Following this, with a sputtering method, a Ti film having a thickness of 300 nm is deposited as a cathode electrode 2 and then an SiNx film having a thickness of 100 nm is deposited as an electron blocking layer 3 using a CVD method.

Next, on the SiNx film, an $SiO_2$ film having a thickness of 400 nm is first deposited using a CVD method and then a Ta film having a thickness of 100 nm is deposited as a gate electrode using a sputtering method.

As to the lamination substrate formed in the manner described above, 104 opening regions having a size of Ø0.5 μm are formed in a gate electrode by performing dry etching using photolithography or RIE techniques. Following this, the $SiO_2$ layer and the SiNx film are etched by RIE successively and this etching operation is terminated at the surface of the cathode electrode. During this operation, in the step of etching the $SiO_2$ layer and the SiNx film, an etching condition is adjusted so that there is obtained a tapered shape.

Next, the $SiO_2$ layer is etched using buffered hydrofluoric acid, thereby forming the recess structure shown in FIG. 3C Next, on the lamination substrate formed in the manner described above, a diamond like carbon film having a thickness of 50 nm is deposited as the electron-emitting layer using a CVD method. During this operation, a photoresist layer used for the above-mentioned etching operation is used as a lift-off layer.

The electron-emitting device produced in the manner described above is arranged in a vacuum container, a pulse voltage of 15 V is applied between the gate electrode and the cathode electrode, and a phosphor, to which a voltage of 10 kV is applied, is arranged above the electron-emitting device with a distance of 2 mm therebetween.

As a result, it has been confirmed that an electron beam converges to have a diameter of 32 μm.

Second Embodiment

On a lamination substrate that is the same as that described in the first embodiment, 104 opening regions, whose size is Ø0.5 μm, are formed using a dry etching apparatus. Note that the etching step in this embodiment is terminated at a point in time when the cathode electrode is concaved by 50 nm.

Next, like in the first embodiment, a diamond like carbon film is deposited as an electron-emitting layer. The electron-emitting layer has the following electron-emitting characteristic evaluated in a vacuum container.

As a result of the evaluation, it has been confirmed that an electron beam converges to have a diameter of 32 μm.

Third Embodiment

The substrate 1 is prepared by sufficiently cleaning quartz. Following this, with a sputtering method, a Pd film having a thickness of 300 nm is deposited as the cathode electrode 2 and then a PdO layer is formed by oxidizing the surface of the Pd electrode, with the thickness of the oxidized surface being 70 nm.

Next, on the PdO layer, an $SiO_2$ film having a thickness of 300 nm is first deposited using a CVD method and then a Ta film having a thickness of 100 nm is deposited as a gate electrode using a sputtering method.

As to the lamination substrate formed in the manner described above, 104 opening regions having a size of Ø0.3 μm are formed in a gate electrode by performing dry etching using photolithography or RIE techniques. Following this, the $SiO_2$ layer is etched by RIE and this etching operation is terminated at the surface of the PdO layer. During this operation, in the step of etching the $SiO_2$ layer, an etching condition is adjusted so that there is obtained a tapered shape.

Next, the $SiO_2$ layer is etched using buffered hydrofluoric acid, thereby forming the recess structure shown in FIG. 3C.

Next, hydrogen ions are irradiated onto the opening regions in a hydrogen reducing atmosphere, thereby reducing the PdO layer only in regions, whose diameter and width are the same as those of the openings, and exposing Pd electrodes.

Next, on the lamination substrate formed in the manner described above, a diamond like carbon film having a thickness of 50 nm is deposited as the electron-emitting layer using a CVD method.

The electron-emitting device produced in the manner described above is arranged in a vacuum container, a pulse voltage of 15 V is applied between the gate electrode and the cathode electrode, and a phosphor, to which a voltage of 10 kV is applied, is arranged above the electron-emitting device with a distance of 2 mm therebetween.

As a result, it has been confirmed that an electron beam converges to have a diameter of 32 μm.

Fourth Embodiment

The substrate 1 is prepared by sufficiently cleaning quartz. Following this, with a sputtering method, a Ti film having a thickness of 300 nm is deposited as the cathode electrode 2.

Next, on the Ti film, an $SiO_2$ film having a thickness of 500 nm is first deposited using a CVD method and then a Ta film having a thickness of 100 nm is deposited as a gate electrode using a sputtering method.

As to the lamination substrate formed in the manner described above, 104 opening regions having a size of Ø0.5 μm are formed in a Ta gate electrode by performing dry etching using photolithography or RIE techniques.

Following this, the $SiO_2$ layer is removed by performing wet etching using buffered hydrofluoric acid and this etching operation is terminated at the surface of the Ti electrode, thereby forming the tapered shape shown in FIG. 11.

Next, on the lamination substrate formed in the manner described above, a diamond like carbon film having a thickness of 50 nm is deposited as the electron-emitting layer using a CVD method.

The electron-emitting device produced in the manner described above is arranged in a vacuum container, a pulse voltage of 15 V is applied between the gate electrode and the cathode electrode, and a phosphor, to which a voltage of 10 kV is applied, is arranged above the electron-emitting device with a distance of 2 mm therebetween.

As a result, it has been confirmed that an electron beam converges to have a diameter of 38 μm.

Fifth Embodiment

Like in the first embodiment, a diamond like carbon film is formed on the lamination substrate. During this operation, a photoresist layer is used as a lift-off layer in the first embodiment. However, in this embodiment, by depositing a diamond like carbon film after the photoresist layer is removed, the surface of the gate electrode is coated with the diamond like carbon film.

The electron-emitting device produced in the manner described above is arranged in a vacuum container, a pulse voltage of 15 V is applied between the gate electrode and the cathode electrode, and a phosphor, to which a voltage of 10 kV is applied, is arranged above the electron-emitting device with a distance of 2 mm therebetween.

As a result, there is obtained an electron beam that converges to have a diameter of 38 μm. Also, even if device discharging occurs during driving, the diamond like carbon film on the gate electrode functions as a protective layer, so that damage inflicted on the device is reduced.

Sixth Embodiment

On the lamination substrate for which opening regions that are the same as those in the first embodiment have been formed, a polycrystalline diamond film is formed as an electron-emitting layer.

The electron-emitting device produced in the manner described above is arranged in a vacuum container, a pulse voltage of 13 V is applied between the gate electrode and the cathode electrode, and a phosphor, to which a voltage of 10 kV is applied, is arranged above the electron-emitting device with a distance of 2 mm therebetween.

As a result, it has been confirmed that an electron beam converges to have a diameter of 38 μm. The converged electron beam is obtained also by using an amorphous carbon film as an electron-emitting layer.

Seventh Embodiment on an N-type Si prepared by sufficiently cleaning as the substrate 1, an SiNx film having a thickness of 100 nm is deposited by using a CVD method. In the present embodiment, the N-type Si serves both as a substrate and a cathode electrode layer.

Next, on the SiNx film, an $SiO_2$ film having a thickness of 400 nm is first deposited using a CVD method and then a Ta film having a thickness of 100 nm is deposited as a gate electrode using a sputtering method.

As to the lamination substrate formed in the manner described above, 104 opening regions having a size of Ø0.5 μm are formed in a gate electrode by performing dry etching using photolithography or RIE techniques. Following this, the $SiO_2$ layer and the SiNx film are etched by RIE successively and this etching operation is terminated at the surface of the cathode electrode. During this operation, in the step of etching the $SiO_2$ layer and the SiNx film, an etching condition is adjusted so that there is obtained a tapered shape.

Next, the $SiO_2$ layer is etched using buffered hydrofluoric acid, thereby forming the recess structure shown in FIG. 3C.

Next, on the lamination substrate formed in the manner described above, a diamond like carbon film having a thickness of 50 nm is deposited as the electron-emitting layer using a CVD method. During this operation, a photoresist layer used for the above-mentioned etching operation is used as a lift-off layer.

The electron-emitting device produced in the manner described above is arranged in a vacuum container, a pulse voltage of 14 V is applied between the gate electrode and the cathode electrode, and a phosphor, to which a voltage of 10 kV is applied, is arranged above the electron-emitting device with a distance of 2 mm therebetween.

As a result, it has been confirmed that an electron beam converges to have a diameter of 37 μm.

Eighth Embodiment

Figure 13:
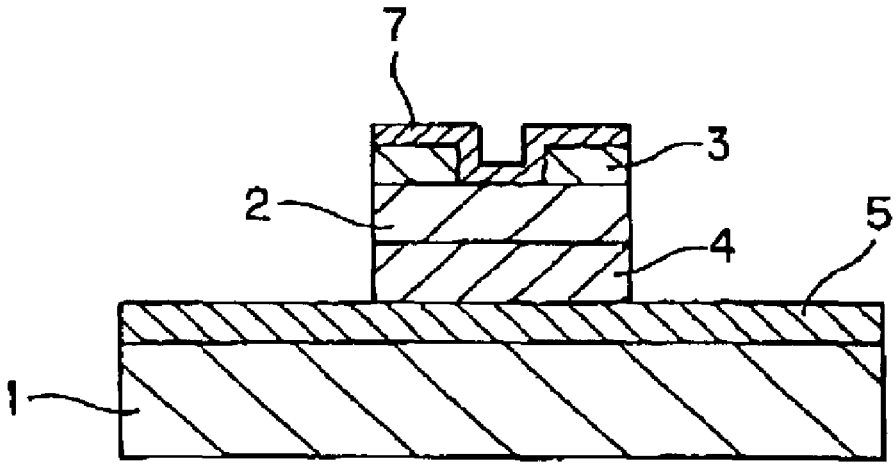
FIG. 13 shows an example of the electron-emitting device of the present invention.

In this embodiment, the structure shown in FIG. 13 will be described.

The substrate 1 is prepared by sufficiently cleaning quartz. Following this, with a sputtering method, a Ta film having a thickness of 300 nm is deposited as the gate electrode 5 and then an $SiO_2$ film having a thickness of 400 nm is deposited as the insulating layer 4 using a CVD method.

Next, on the $SiO_2$ film, a Ti film having a thickness of 100 nm is first deposited with a sputtering method on a cathode electrode and then an SiNx film having a thickness of 100 nm is deposited using a CVD method.

Next, a part of the SiNx film is etched by using photolithography or RIE techniques, and this etching operation is terminated at the surface of the cathode electrode.

Next, on the lamination substrate formed in the manner described above, a diamond like carbon film having a thickness of 50 nm is deposited as the electron-emitting layer using a CVD method.

As to the lamination substrate formed in the manner described above, 104 convex structures having a width of 0.5 μm are formed in a gate electrode by performing dry etching using photolithography or RIE techniques. This etching operation is terminated at the surface of the gate electrode.

The electron-emitting device produced in the manner described above is arranged in a vacuum container, a pulse voltage of 18 V is applied between the gate electrode and the cathode electrode, and a phosphor, to which a voltage of 10 kV is applied, is arranged above the electron-emitting device with a distance of 2 mm therebetween.

As a result, it has been confirmed that an electron bean converges to have a diameter of 32 μm.

Ninth Embodiment

In this embodiment, the structure shown in FIG. 18 will be described.

On an N-type Si prepared by sufficiently cleaning as the substrate 1, an SiNx film having a thickness of 500 nm is deposited by using a CVD method. In the present embodiment, the N-type Si serves both as a substrate and a cathode electrode layer.

Next, on the SiNx film, a Ta film having a thickness of 100 nm is deposited as a gate electrode using a sputtering method.

As to the lamination substrate formed in the manner described above, 104 opening regions having a size of Ø0.5 μm are formed in a gate electrode by performing dry etching using photolithography or RIE techniques. This etching operation is terminated at the surface of the N-type Si.

Next, the SiNx film is etched using phosphoric acid, thereby forming the recess structure.

Next, the lamination substrate formed in the manner described above is subjected to thermal oxidization in an oxygen atmosphere of 900° C. and $SiO_2$ layers are selectively formed only in regions whose N-type Si is exposed to the surface. The $SiO_2$ layers formed during this operation have a thickness of 80 nm.

Next, by using gate electrode opening regions as masks, the $SiO_2$ layers described above are partially removed by RIE. Regions of the $SiO_2$ layers that remain even after this step become electron blocking layers.

Next, on the lamination substrate formed in the manner described above, a diamond like carbon film having a thickness of 50 nm is deposited as the electron-emitting layer using a CVD method.

The electron-emitting device produced in the manner described above is arranged in a vacuum container, a pulse voltage of 14 V is applied between the gate electrode and the cathode electrode, and a phosphor, to which a voltage of 10 kV is applied, is arranged above the electron-emitting device with a distance of 2 mm therebetween.

As a result, it has been confirmed that an electron beam converges to have a diameter of 37 μm.

Tenth Embodiment

In this embodiment, a device structure shown in FIG. 19 will be described.

The substrate 1 is prepared by sufficiently cleaning quartz. Following this, with a sputtering method, a Ti film having a thickness of 300 nm is deposited as the cathode electrode 2 and then an SiNx film having a thickness of 100 nm is deposited as the electron blocking layer 3 using a CVD method.

Next, on the SiNx film, an $SiO_2$ film having a thickness of 400 nm is first deposited using a CVD method and then a Ta film having a thickness of 100 nm is deposited as a gate electrode using a sputtering method.

As to the lamination substrate formed in the manner described above, 104 opening regions having a size of Ø0.5 μm are formed in a gate electrode by performing dry etching using photolithography or RIE techniques. Following this, the $SiO_2$ layer and the SiNx film are etched by RIE successively and this etching operation is terminated at the surface of the cathode electrode. During this operation, in the step of etching the $SiO_2$ layer and the SiNx film, an etching condition is adjusted so that there is obtained a tapered shape.

Next, the $SiO_2$ layer is etched using buffered hydrofluoric acid, thereby forming the recess structure shown in FIG. 3C Next, on the substrate that has been processed in the manner described above, a Pd layer (a layer including plurality of Pd particles) having a thickness of 10 nm is deposited as the catalytic conductive layer 100 and carbon nanotubes grow selectively on the above-mentioned Pd particles using a general CVD method.

The electron-emitting device produced in the manner described above is arranged in a vacuum container, a pulse voltage of 9 V is applied between the gate electrode and the cathode electrode, and a phosphor, to which a voltage of 10 kV is applied, is arranged above the electron-emitting device with a distance of 2 mm therebetween.

As a result, it has been confirmed that an electron beam converges to have a diameter of 34 μm.

Eleventh Embodiment

Image-forming apparatuses are manufactured by arranging respective devices of the first to tenth embodiments in a 100 by 100 matrix manner. As one example, there will be described a case where the device of the first embodiment is used. As to a wiring, X wiring is connected to the cathode electrode 2 and Y wiring is connected to the gate electrode 5, as shown in FIG. 14. The electron-emitting devices are arranged by setting the 104 opening regions as one pixel, setting the horizontal pitch at 30 μm, and setting the vertical pitch at 100 μm. Phosphors are aligned and arranged above the devices at a position where a distance of 2 mm is maintained therebetween. A voltage of 10 kV is applied to the phosphors. The circuit shown in FIG. 17 is driven using an input signal. As a result, there is formed a high-definition image-forming apparatus.

As described above, with the technique of the present invention, there is obtained a structure where a cathode electrode and a gate electrode are arranged on a substrate and a region of an electron-emitting layer arranged on the cathode electrode is connected to the cathode electrode through an electron blocking layer. With this structure, the electron-emitting layer selectively performs electron emission only from its region contacting the cathode electrode, whereby the converging property of an electron beam generated by the electron-emitting device can be enhanced.

Also, by applying the electron-emitting device having the structure described above, it becomes possible to enhance the performance of an electron source and image-forming apparatus.

What claimed is:

1. An electron-emitting device comprising:

a cathode electrode;

a substrate arranged under the cathode electrode;

an electron blocking layer arranged over a part of the cathode electrode;

a gate electrode to which a potential is applied, the potential being higher than a potential which is applied to the cathode electrode for electron emission; and an electron-emitting film having (A) a first portion arranged over a portion of the cathode electrode which is not covered with the electron blocking layer and (B) a second portion arranged over the electron blocking layer and arranged over the cathode electrode, wherein the electron-emitting film has a resistivity that is equal to at least 10 Ω·cm, and wherein the gate electrode has an opening in which the first portion and the second portion are arranged, and the first portion and the second portion are not electrically connected to the gate electrode.

2. An electron-emitting device according to claim 1, further comprising:

an insulating layer disposed between the gate electrode and the cathode electrode, wherein the gate electrode is arranged over the cathode electrode, wherein an opening penetrates the insulating layer and the gate electrode, and wherein the first portion is exposed in the opening.

3. An electron-emitting device according to claim 2, wherein an upper end surface of the cathode electrode contacting the electron-emitting film is arranged at a position that is closer to the substrate than an upper end surface of the cathode electrode contacting the electron blocking layer.

4. An electron-emitting device according to claim 1, wherein a main ingredient of the electron-emitting film is carbon.

5. An electron-emitting device according to claim 1, wherein the electron-emitting film is one of a diamond-like carbon film and an amorphous carbon film.

6. An electron-emitting device according to claim 1, wherein the electron blocking layer is an insulating layer or a semiconductor layer.

7. An electron-emitting device according to claim 1, wherein an emission amount of electrons emitted from the first portion is 10% or less of an emission amount of electrons emitted from the second portion.

8. An electron-emitting device according to claim 1, wherein resistivity of a connection portion of the electron-emitting film between the second portion and the first portion is at least equal to $10^2$ Ω·cm.

9. An electrode source, comprising:

a plurality of arranged electron-emitting devices, each being an electron-emitting device according to claim 1.

10. An image-forming apparatus comprising:

an electron source according to claim 9; and a light-emitting member that emits light by irradiation of electrons emitted from the electron source.

11. An electron-emitting device comprising:
a cathode electrode;
a substrate arranged under the cathode electrode;
a first insulating layer arranged over a part of the cathode electrode;
a gate electrode to which a potential is applied, the potential being higher than a potential which is applied to the cathode electrode for electron emission; and
an electron-emitting film having (A) a first portion arranged over a portion of the cathode electrode which is not covered with the first insulating layer and (B) a second portion arranged over the first insulating layer and arranged over the cathode electrode,
wherein the electron-emitting film has a resistivity that is equal to at least 10 Ω·cm, and
wherein the gate electrode has an opening in which the first portion and the second portion are arranged, and the first portion and the second portion are not electrically connected to the gate electrode.

12. An electron-emitting device according to claim 11, further comprising:
a second insulating layer disposed between the gate electrode and the cathode electrode,
wherein the gate electrode is arranged over the cathode electrode,
wherein an opening penetrates the second insulating layer and the gate electrode, and
wherein the first portion is exposed in the opening.

13. An electron-emitting device according to claim 11,
wherein an upper end surface of the cathode electrode contacting the electron-emitting film is arranged at a position that is closer to the substrate than an upper end surface of the cathode electrode contacting the electron blocking layer.

14. An electron-emitting device according to claim 11,
wherein a main ingredient of the electron-emitting film is carbon.

15. An electron-emitting device according to claim 11,
wherein the electron-emitting film is one of a diamond like carbon film and an amorphous carbon film.

16. An electron-emitting device according to claim 11,
wherein an emission amount of electrons emitted from the first portion is 10% or less of an emission amount of electrons emitted from the second portion.

17. An electron-emitting device according to claim 11,
wherein a resistivity of a connection portion of the electron-emitting film between the second portion and the first portion is at least $10^2$ Ω·cm.

18. An electron source, comprising:
a plurality of arranged electron-emitting devices, each being an electron-emitting device according to claim 11.

19. An image-forming apparatus comprising:
an electron source according to claim 17; and
a light-emitting member that emits light by irradiation of electrons emitted from the electron source.

20. An electron-emitting device comprising:
a cathode electrode;
a substrate arranged under the cathode electrode;
an electron blocking layer arranged over a part of the cathode electrode;
a gate electrode to which a potential is applied, the potential being higher than a potential which is applied to the cathode electrode for electron emission; and
an electron-emitting film having (A) a first portion arranged over a portion of the cathode electrode which is not covered with the electron blocking layer and (B) a second portion arranged over the electron blocking layer and arranged over the cathode electrode, and the second portion being arranged around the first portion,
wherein the gate electrode is not positioned between the second portion and the electron blocking layer, but is positioned above or below the second portion and the electron blocking layer, and
wherein the electron-emitting film has a resistivity that is equal to at least 10 Ω·cm.

21. An image-forming apparatus comprising:
an electron-emitting device according to claim 20; and
a light-emitting member that emits light by irradiation of electrons emitted from the electron-emitting device.

22. An electron-emitting device comprising:
a cathode electrode;
a substrate arranged under the cathode electrode;
an electron blocking layer arranged over a part of the cathode electrode;
a gate electrode to which a potential is applied, the potential being higher than a potential which is applied to the cathode electrode for electron emission; and
an electron-emitting film having (A) a first portion arranged over a portion of the cathode electrode which is not covered with the electron blocking layer and (B) a second portion arranged over the electron blocking layer and arranged over the cathode electrode,
wherein the electron-emitting film has a resistivity that is equal to at least 10 Ω·cm, and
wherein the first portion and second portion form a continuous single film.

23. An image-forming apparatus comprising:
an electron-emitting device according to claim 22; and
a light-emitting member that emits light by irradiation of electrons emitted from the electron-emitting device.

24. An electron-emitting device comprising:
a cathode electrode;
a substrate arranged under the cathode electrode;
an electron blocking layer arranged over a part of the cathode electrode;
a gate electrode to which a potential is applied, the potential being higher than a potential which is applied to the cathode electrode for electron emission; and
an electron-emitting film having (A) a first portion arranged over a portion of the cathode electrode which is not covered with the electron blocking layer and (B) a second portion arranged over the electron blocking layer and arranged over the cathode electrode,
wherein the electron-emitting film has a resistivity that is equal to at least 10 Ω·cm, and is connected to the cathode electrode without being electrically connected to the gate electrode.

25. An image-forming apparatus comprising:
an electron-emitting device according to claim 24; and
a light-emitting member that emits light by irradiation of electrons emitted from the electron-emitting device.

26. An electron-emitting device comprising:
a cathode electrode;
a substrate arranged under the cathode electrode;
a first insulating layer arranged over a part of the cathode electrode;
a gate electrode to which a potential is applied, the potential being higher than a potential which is applied to the cathode electrode for electron emission; and
an electron-emitting film having (A) a first portion arranged over a portion of the cathode electrode which is not covered with the first insulating layer and (B) a second portion arranged over the first insulating layer and arranged over the cathode electrode, and the second portion being arranged around the first portion, wherein the gate electrode is not positioned between the second portion and the first insulating layer, but is positioned above or below the second portion and the first insulating layer, and wherein the electron-emitting film has a resistivity that is equal to at least 10 Ω·cm.

27. An image-forming apparatus comprising:

an electron-emitting device according to claim 26; and a light-emitting member that emits light by irradiation of electrons emitted from the electron-emitting device.

28. An electron-emitting device comprising:

a cathode electrode;

a substrate arranged under the cathode electrode;

a first insulating layer arranged over a part of the cathode electrode;

a gate electrode to which a potential is applied, the potential being higher than a potential which is applied to the cathode electrode for electron emission; and an electron-emitting film having (A) a first portion arranged over a portion of the cathode electrode which is not covered with the first insulating layer and (B) a second portion arranged over the first insulating layer and arranged over the cathode electrode, wherein the electron-emitting film has a resistivity that is equal to at least 10 Ω·cm, and wherein the first portion and second portion form a continuous single film.

29. An image-forming apparatus comprising:

an electron source according to claim 28; and a light-emitting member that emits light by irradiation of electrons emitted from the electron-emitting device.

30. An electron-emitting device comprising:

a cathode electrode;

a substrate arranged under the cathode electrode;

a first insulating layer arranged over a part of the cathode electrode;

a gate electrode to which a potential is applied, the potential being higher than a potential which is applied to the cathode electrode for electron emission; and an electron-emitting film having (A) a first portion arranged over a portion of the cathode electrode which is not covered with the first insulating layer and (B) a second portion arranged over the first insulating layer and arranged over the cathode electrode, wherein the electron-emitting film has a resistivity that is equal to at least 10 Ω·cm, and is connected to the cathode electrode without being electrically connected to the gate electrode.

31. An image-forming apparatus comprising:

an electron-emitting device according to claim 30; and a light-emitting member that emits light by irradiation of electrons emitted from the electron-emitting device.

* * * * *

UNITED STATES PATENT AND TRADEMARK OFFICE

CERTIFICATE OF CORRECTION

PATENT NO. : 7,276,843 B2
APPLICATION NO. : 10/178273
DATED : October 2, 2007
INVENTOR(S) : Daisuke Sasaguri It is certified that error appears in the above-identified patent and that said Letters Patent is hereby corrected as shown below:

COLUMN 2:

Line 30, “agate” should read --a gate--.

COLUMN 3:

Line 6, “diamond like” should read --diamond-like--;
Line 38, “In” should read --¶ In--.

COLUMN 4:

Line 65, “Firstly,” should read --¶ Firstly,--.

COLUMN 5:

Line 10, “zr,” should read --Zr,--.

COLUMN 7:

Line 21, “diamond like” should read --diamond-like--;
Line 32, “use” should read --to use--.

COLUMN 8:

Line 53, “Fibers)” should read --fibers).--;
Line 58, “a” should be deleted.

COLUMN 9:

Line 28, “of” should read --a--;
Line 45, “then” should read --the n--.

COLUMN 10:

Line 23, “strip,” should read --stripe,--.

UNITED STATES PATENT AND TRADEMARK OFFICE

CERTIFICATE OF CORRECTION

PATENT NO. : 7,276,843 B2
APPLICATION NO. : 10/178273
DATED : October 2, 2007
INVENTOR(S) : Daisuke Sasaguri It is certified that error appears in the above-identified patent and that said Letters Patent is hereby corrected as shown below:

COLUMN 13:

Line 23, "Next," should read --¶ Next,--;
Line 23, "diamond like" should read --diamond-like--;
Line 46, "diamond like" should read --diamond-like--.

COLUMN 14:

Line 14, "diamond like" should read --diamond-like--;
Line 43, "diamond like" should read --diamond-like--;
Line 57, "diamond like" should read --diamond-like--;
Line 61, "diamond like" should read --diamond-like--;
Line 63, "diamond like" should read --diamond-like--.

COLUMN 16:

Line 59, "diamond like" should read --diamond-like--.

COLUMN 17:

Line 28, "Next," should read --¶ Next,--.

COLUMN 19:

Line 39, "diamond" should read --diamond- --.

Signed and Sealed this

Thirteenth Day of May, 2008

JON W. DUDAS
*Director of the United States Patent and Trademark Office*